US011120727B2

(12) United States Patent
Li et al.

(10) Patent No.: US 11,120,727 B2
(45) Date of Patent: Sep. 14, 2021

(54) IMAGE PROCESSING METHOD AND DEVICE, AND DISPLAY DEVICE

(71) Applicant: BOE TECHNOLOGY GROUP CO., LTD., Beijing (CN)

(72) Inventors: Zhenzhen Li, Beijing (CN); Hui Zhao, Beijing (CN); Wenjing Tan, Beijing (CN)

(73) Assignee: BOE TECHNOLOGY GROUP CO., LTD., Beijing (CN)

( * ) Notice: Subject to any disclaimer, the term of this patent is extended or adjusted under 35 U.S.C. 154(b) by 0 days.

(21) Appl. No.: 16/915,114

(22) Filed: Jun. 29, 2020

(65) Prior Publication Data

US 2021/0005128 A1 Jan. 7, 2021

(30) Foreign Application Priority Data

Jul. 4, 2019 (CN) ..... 201910599326.3

(51) Int. Cl.
*G09G 3/20* (2006.01)
*G09G 3/3225* (2016.01)

(52) U.S. Cl.
CPC ..... *G09G 3/2007* (2013.01); *G09G 3/2003* (2013.01); *G09G 3/3225* (2013.01);
(Continued)

(58) Field of Classification Search
CPC ... G09G 2320/0233; G09G 2320/0285; G09G 2320/0673; G09G 2320/0686;
(Continued)

(56) References Cited

U.S. PATENT DOCUMENTS 10,311,807 B2 6/2019 Chen
10,720,088 B1 * 7/2020 Li ..... G09G 3/3208
(Continued)

FOREIGN PATENT DOCUMENTS

CN 106023916 A 10/2016
CN 108550345 A 9/2018
(Continued)

OTHER PUBLICATIONS

Office Action issued in corresponding Chinese Patent Application No. 201910599326.3, dated Dec. 3, 2020.

*Primary Examiner* — Kenneth Bukowski
(74) *Attorney, Agent, or Firm* — McDermott Will & Emery LLP

(57) ABSTRACT

The present disclosure provides an image processing method and device, and a display device. The image processing method comprises: acquiring an image brightness information; obtaining a gray scale compensation parameter of at least two band points of each first sub-image area according to brightness information and reference brightness of the at least two band points comprised in the brightness information of each first sub-image area of the image brightness information; obtaining the gray scale compensation information of each first sub-image area according to the gray scale compensation parameters of the at least two band points; and compensating the gray scale of the image according to the gray scale information of the M of first sub-image areas.

12 Claims, 10 Drawing Sheets

(52) U.S. Cl.
CPC ..... *G09G 2320/0233* (2013.01); *G09G 2320/0673* (2013.01); *G09G 2320/0686* (2013.01)

(58) Field of Classification Search
CPC .. G09G 3/2003; G09G 3/2007; G09G 3/3208; G09G 3/3225
See application file for complete search history.

(56) References Cited

U.S. PATENT DOCUMENTS

| | | | | |
|---|---|---|---|---|
| 2014/0285533 | A1 | 9/2014 | Chun et al. | |
| 2015/0379922 | A1 | 12/2015 | Zhang | |
| 2016/0351101 | A1* | 12/2016 | Lee | G09G 3/3225 |
| 2017/0069238 | A1* | 3/2017 | Moon | G09G 3/007 |
| 2018/0204529 | A1 | 7/2018 | Chen | |
| 2020/0286423 | A1 | 9/2020 | Yu et al. | |

FOREIGN PATENT DOCUMENTS

| | | | |
|---|---|---|---|
| CN | 108694906 | A | 10/2018 |
| CN | 109256101 | A | 1/2019 |

* cited by examiner

IMAGE PROCESSING METHOD AND DEVICE, AND DISPLAY DEVICE

CROSS-REFERENCE TO RELATED APPLICATION (S)

This application claims priority to Chinese Application No. 201910599326.3 filed on Jul. 4, 2019, the contents of which are incorporated herein by reference in their entirety.

TECHNICAL FIELD

The present disclosure relates to the field of image processing technology, more particular, to an image processing method and device, and a display device.

BACKGROUND

An organic light-emitting diode (OLED) display device is a display device made of organic electroluminescence diodes.

The OLED display device may comprise a display driving circuit and an array of light emitting devices. In order to drive the array of light-emitting devices to emit light, various signal lines such as power signal lines, data signal lines, and common power supply lines are arranged in the OLED display device, so as to support a pixel compensation circuit to drive the array of light-emitting devices to emit light. Due to a IR voltage drop, the signal voltage transmitted by these signal lines changes gradually in a direction away from the signal terminals, which may result in an uneven brightness of the light emitted by the array of light emitting devices, obtaining a poor brightness uniformity of the image displayed by the OLED display device.

SUMMARY

The present disclosure provides an image processing method. The image processing method comprises:

acquiring an image brightness information of an image to be displayed, the image brightness information comprising a brightness information of M of first sub-image areas arranged in a first direction, the brightness information of each first sub-image area comprises a brightness information of at least two band points, M is an integer greater than 1;

obtaining a gray scale compensation parameter of the at least two band points of each first sub-image area, according to the brightness information of the at least two band points of each first sub-image area and a reference brightness;

obtaining a gray scale compensation information of each first sub-image area, according to the gray scale compensation parameter of the at least two band points of each first sub-image area;

acquiring an image information of the image to be displayed, and performing a gray scale compensation process on the image information, according to the gray scale compensation information of the M of first sub-image areas.

The present disclosure provides an image processing device. The image processing device comprises:

an acquiring unit, configured to acquire an image brightness information and an image information, the image brightness information comprising a brightness information of M of first sub-image areas arranged in a first direction, the brightness information of each first sub-image area comprises a brightness information of at least two band points;

a compensation setting unit, configured to obtain a gray scale compensation parameter for the at least two band points, according to the brightness information of the at least two band points of each first sub-image area and a reference information, and obtain the gray scale compensation information of each first sub-image area according to the gray scale compensation parameter of the at least two band points; and a gray scale compensation unit, configured to perform the gray scale compensation process on the image information according to the gray scale compensation information of the M of first sub-image areas.

The present disclosure provides an image processing device. The image processing device comprises: a memory having instructions stored thereon and a processor configured to execute the instructions so as to implement the image processor method of embodiments of the present disclosure.

The present disclosure also provides a display device comprising a display panel, a signal generation chip, and an image processing device according to an embodiment of the present disclosure.

The present disclosure also provides a computer storage medium. The computer storage medium stores instructions, and when the instructions are executed, the above image processing method is implemented.

The present disclosure also provides a display device. The display device comprises the above-described image processing device.

BRIEF DESCRIPTION OF THE DRAWINGS

The drawings described herein are used to provide a more comprehensive understanding of the present disclosure and constitute a part of the present disclosure. The exemplary embodiments and descriptions of the present disclosure are used to explain the present disclosure, and do not constitute a limitation of the present disclosure. In the drawings.

DETAILED DESCRIPTION

In the following, specific implementations of the present disclosure are discussed in detail in combination of the figures and various embodiments. The following embodiments are intended to illustrate a part of embodiments of the present disclosure, rather than all of the embodiments of the present disclosure. All other embodiments obtained by those of ordinary skill in the art based on the embodiments of the present disclosure without creative effort are intended to be included in the scope of the present disclosure.

Figure 1:
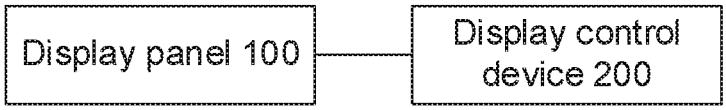
FIG. 1 shows a structural block diagram of a display device.
Figure 2:
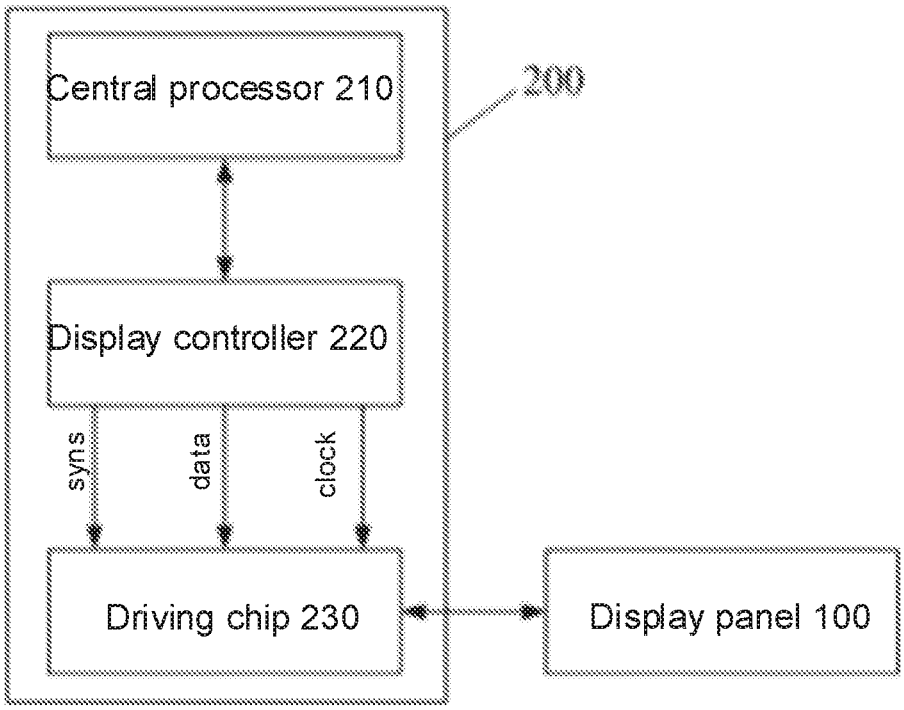
FIG. 2 shows a structural block diagram of another display device.
Figure 3:
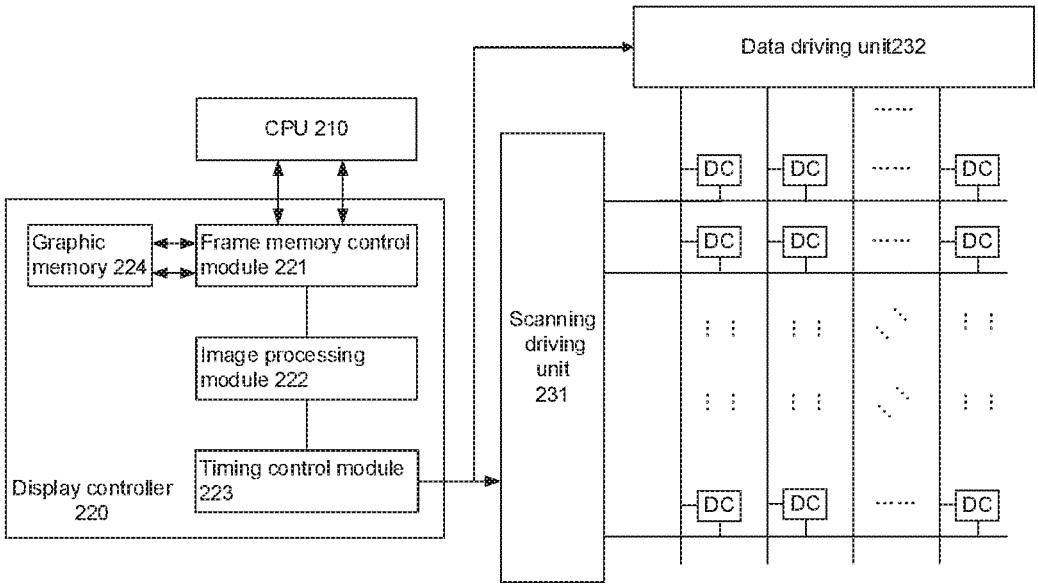
FIG. 3 shows a structural block diagram of another display device.

FIG. 1 shows a display device. As shown in FIG. 1, the above display device comprises a display panel and a display control device. As shown in FIG. 2, the above-mentioned display control device 200 may comprise a central processor 210, a display controller 220 and a driving chip 230. As shown in FIG. 3, the display controller 220 comprises a frame memory control module 221, an image processing module 222, a timing control module 223, and a graphics memory 224. The driving chip 230 shown in FIG. 2 comprises a scanning driving unit 231 and a data driving unit 232. The frame memory control module 221 is electrically connected to the graphics memory 224, the central processor 210 is communicatively connected to the frame memory control module 221, the image processing module 222 is connected to the frame memory control module 221, the image processing module 222 is communicatively connected to a timing control module 223; and the timing control module 223 is connected to the scan driving unit 231 and the data driving unit 232 through a scanning control link. The timing controller is only used to generate a synchronization signal. With the development of display control technology, the timing controller also has an image processing function, so that the timing controller can process a video signal.

As shown in FIG. 3, there are various types of the display panels 100, such as an OLED display panel or a liquid crystal display (LCD). The display panel, regardless of whether it is an OLED display panel or an LCD display panel, is mainly made by a film forming process such as evaporation. If the film is not formed uniformly, it will result in an uneven pixel unit film layer formed on the OLED display panel or LCD display panel, thereby causing a picture displayed on the OLED display panel or LCD display panel having an uneven brightness.

For an OLED display panel, the above-mentioned display panel may comprise display driving circuits stacked in layers and light emitting devices EL arranged in an array. The display driving circuit comprises pixel compensation circuits PDC arranged in the array. The pixel compensation circuits PDC arranged in the array are electrically connected to the light emitting devices in the array EL. The pixel compensation circuits PDC arranged in the array are also electrically connected to the scan driving unit 231 and the data driving unit 232 shown in FIG. 3. The pixel compensation circuit can also be connected to wires required for pixel compensation, such as power supply lines.

Figure 4:
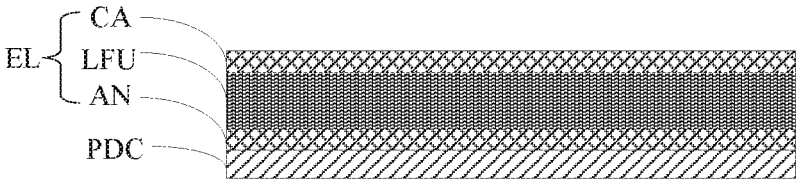
FIG. 4 shows a schematic diagram of a pixel structure of another display device.

As shown in FIG. 4, each pixel of the display panel comprises a pixel compensation circuit PDC and a light emitting device EL.

Figure 5:
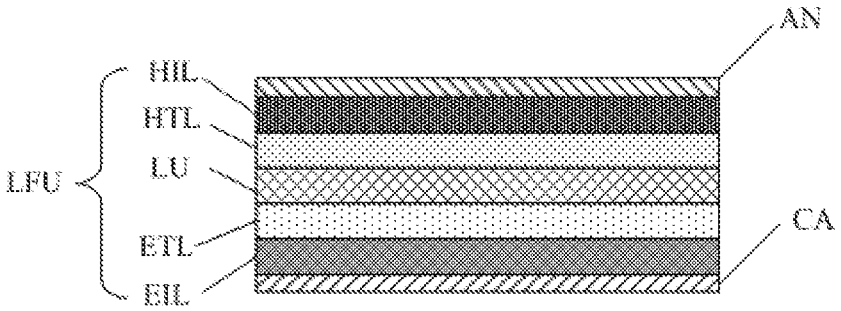
FIG. 5 shows a schematic structural view of a light-emitting device.

FIG. 4 shows a schematic structural view of a light-emitting device EL. As shown in FIG. 4, the light-emitting device EL has a sandwiched structure and comprises a cathode layer CA, an anode layer AN, and a light-emitting functional layer LFU between the anode layer AN and the cathode layer CA. As shown in FIG. 5, the light-emitting functional layer LFU comprises an electron injection layer EIL, an electron transport layer ETL, a light-emitting layer LU, a hole transport layer HTL, and a hole injection layer HIL stacked sequentially.

When the light emitting device EL shown in FIG. 5 needs to emit light, as shown in FIGS. 4 and 5, the anode layer AN injects holes into the hole injection layer HIL, and transfers them to the light emitting layer through the hole transport layer HTL. At the same time, the cathode layer CA injects electrons into the electron injection layer EIL, and transfers them to the light emitting layer LU through the electron transport layer ETL. Eventually, electrons and holes recombine into excitons in the light-emitting layer LU, and the energy of the excitons is transferred and released in the form of light, thereby enabling the light-emitting device EL to emit light as shown in FIG. 4.

Figure 6:
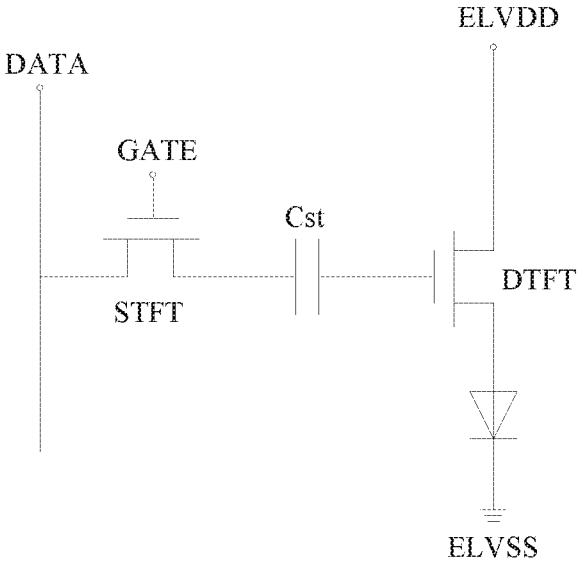
FIG. 6 shows a structural diagram of a 2T1C pixel compensation circuit.

The pixel compensation circuit PDC shown in FIG. 4 may be any one of a 2T1C pixel compensation circuit and a 3T1C pixel compensation circuit, but it is not limited thereto. The pixel compensation circuit comprises a storage capacitor Cst, a switching transistor, and a driving transistor DTFT for driving the light-emitting device EL to emit light, for example, the 2T1C pixel compensation circuit shown in FIG. 6. In the 2T1C pixel compensation circuit, the gate signal provided by the gate signal terminal GATE can control the turning off/on of the switching transistor STFT, and the data signal provided by the data signal terminal DATA enable the data signal voltage to be written into the storage capacitor Cst via the switching transistor STFT. The storage capacitor Cst controls the driving transistor DTFT to remain in an on state so that the power signal provided by the power signal terminal ELVDD drives the light emitting device EL to emit light through the driving transistor DTFT. It should be understood that a cathode of the light emitting device can be connected to a common power terminal ELVSS. The switching transistor STFT and the driving transistor DTFT mentioned above may be both selected as thin film transistors. The type of the thin film transistor may be an NMOS type thin film transistor or a PMOS type thin film transistor, and the difference is only in the conduction condition. With respect to the NMOS type thin film transistor, it is turned on under a high level and turned off under a low level; and with respect to the PMOS type thin film transistor, it is turned on under the low level and turned off under the high level.

Signal terminals such as the data signal terminal DATA, the common power supply terminal ELVSS, the gate signal terminal GATE, and the power supply signal terminal ELVDD may be located at the edges of the OLED display panel, and lead out from a signal processor such as a signal generation chip. Each of signal lines connected to these signal terminals may have an IR voltage drop, causing the signal voltage transmitted by the signal lines to change along the extending direction of the signal lines gradually. Especially, for large-sized display panels, the change of signal voltage along the extension direction of the signal lines caused by the IR voltage drop is more obvious. Since the brightness of the light emitting device in the pixel compensation circuit is related to the power signal voltage, the brightness of the screen displayed by the OLED display panel decreases along the direction away from the power signal terminal gradually, resulting in a poor uniformity of the screen displayed by the OLED display panel. The IR voltage drop refers to a phenomenon that voltages on power and ground networks in integrated circuits decreases or increases. For example, the voltage at positions of the power signal line near the power supply terminal is higher than the voltage at the positions far from the power signal terminal.

Figure 7:
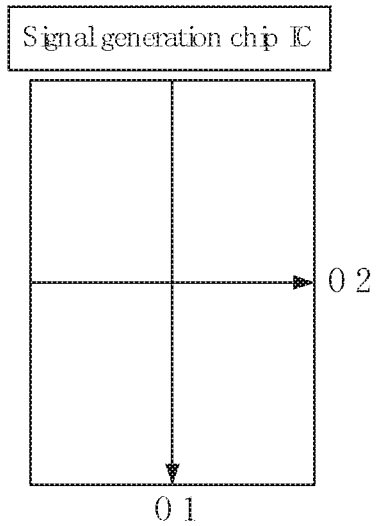
FIG. 7 shows a schematic diagram of a first direction and a second direction in an embodiment of the present disclosure.
Figure 8:
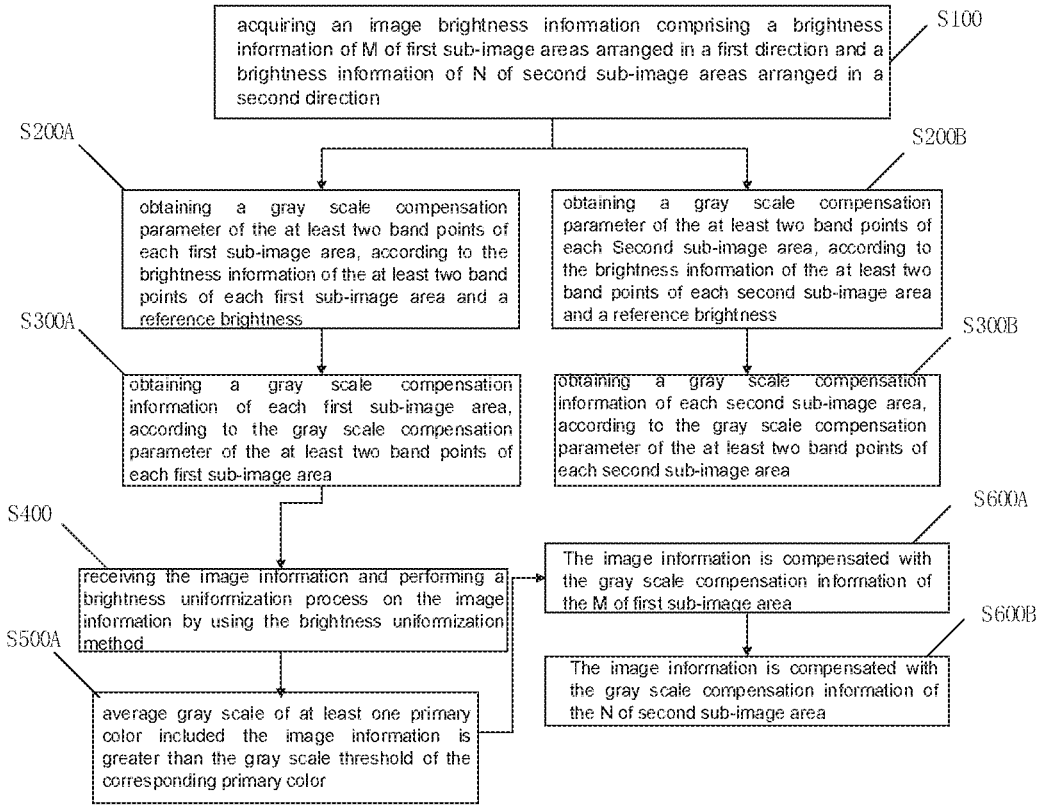
FIG. 8 shows a flowchart of an image processing method according to an embodiment of the present disclosure.

In response to the above problems, an embodiment of the present disclosure provides an image processing method. As shown in FIGS. 7 and 8, the image processing method may comprise following steps.

In step S100, the image brightness information of the image is acquired. The image brightness information comprises a brightness information of M of first sub-image areas arranged in a first direction, and the brightness information of each first sub-image area comprises a brightness information of at least two band points. The first direction may be a direction in which the signal line is away from the signal generation chip. For example, FIG. 7 shows that the signal transmission chip where the power signal terminal is located is positioned on the upper frame of the display device, at this time, the first direction refers to the direction indicated by the first arrow 01 in FIG. 7. The second direction refers to the direction indicated by the second arrow 02 in FIG. 7, and the second direction is perpendicular to the first direction.

The image brightness information can be collected by a light collection device, such as a light sensor, for example, a charge coupled device (CCD) image sensor. Before acquiring the brightness information of the image, the display device may be divided into M of first display areas along the first direction (such as the width direction), so that the image displayed by the display device is divided into M of first sub-image areas. When acquiring an image, the image displayed by the display device may contain at least two band point image information, so that the collected brightness information of each first sub-image area comprises brightness information of at least two band points.

In step S200A, a gray scale compensation parameter of the at least two band points of each first sub-image area is obtained, according to the brightness information of the at least two band points of each first sub-image area and a reference brightness $L_0$.

In step S300A, a gray scale compensation information of each first sub-image area is obtained, according to the gray scale compensation parameter of the at least two band points of each first sub-image area. The gray scale compensation parameter of the at least two band points of each first sub-image area can be data-fitted by using a fitting method, so as to obtain respective gray scale compensation parameters for the first sub-image area. For example, for an 8-bit image, the gray scale of each first sub-image area is between 0 and 255, and correspondingly has 256 gray scale compensation parameters. Each gray scale compensation parameter of the first sub-image area may constitute gray scale compensation information of the first sub-image area. There are various fitting methods, such as linear interpolation and other fitting methods. The obtained gray scale compensation information of each first sub-image area may be stored in the memory. The memory may be a storage device or a collective term for multiple storage elements, and is used to store executable program code and the like. The memory may comprise random access memory (RAM) or non-volatile memory (non-volatile memory), such as disk memory, flash memory (Flash), and so on.

In step S400, the image information of the image is acquired, and a brightness uniformization process is performed on the image information by using a brightness uniformization method.

In step S600A, the gray scale compensation process is performed on the image information according to the gray scale compensation information of the M of first sub-image areas. Here, performing the gray scale compensation process on the image information according to the gray scale compensation information of the M of first sub-image areas comprises performing a bijection gray scale compensation process on pixels of the M of first sub-image area included in the image information according to the gray scale compensation information of the M of first sub-image areas.

The image brightness information comprises a brightness information of M of first sub-image areas arranged in a first direction. Since the brightness information of each first sub-image area comprises the brightness information of at least two band points, a gray scale compensation parameter of the at least two band points of each first sub-image area may be obtained according to the brightness information of the at least two band points of each first sub-image area and a reference brightness $L_0$. The gray scale compensation information of each first sub-image area is obtained according to the gray scale compensation parameter of the at least two band points of each first sub-image area. If there is an IR pressure drop along the first direction, then the gray scale compensation is performed on at least a portion of the M of first sub-image areas by using the gray scale compensation information of the M of first sub-image areas, thereby reducing the problem of a poor uniformity of image brightness caused by the IR voltage drop. By using the above mentioned method, the poor uniformity of image brightness due to uneven film formation can also be alleviated.

In some embodiments, as shown in FIG. 8, in order to ensure a better brightness uniformity of the image being image processed, after acquiring the image information, the above step S400 may further comprise: performing a brightness uniformization process on the image information by using a brightness uniformization method. There are many brightness uniformization methods, which can be selected according to actual needs.

In some embodiments, the above image processing method is to perform the gray scale compensation process on the M of first sub-image areas included in the image information along the first direction. This gray scale compensation method is suitable for display devices with a large size in one direction and a small size in other directions, such as mobile phones.

For a large-sized display device, the brightness unevenness exists in both the width direction and the height direction of the displayed screen. Since the signal generation chip of the display device is usually provided on the upper frame and the side frame of the display device, the image brightness information comprises a brightness information of N of second sub-image areas arranged in a second direction, and the brightness information of each second sub-image area comprises a brightness information of at least two band points. Here the second direction is perpendicular to the first direction. For example, the first direction refers to the direction indicated by the first arrow 01 in FIG. 7, and the second direction refers to the direction indicated by the second arrow 02 in FIG. 7.

The above image brightness information comprises a brightness information of M of first sub-image areas arranged in a first direction and a brightness information of N of second sub-image areas arranged in a second direction. Before acquiring the brightness information of the image, the display device may be divided into N of second display areas along the second direction (such as the width direction), so that the image displayed by the display device is divided into N of second sub-image areas along the second direction. In this manner, the brightness information of the N of second sub-image areas arranged in the second direction can be collected by the light collection device.

When acquiring an image, the image displayed by the display device may contain at least two band point image information, so that the collected brightness information of each first sub-image area comprises brightness information of at least two band points.

As shown in FIG. 8, after acquiring the image brightness information of the image to be displayed and before acquiring the image information, the above image processing method further comprises the following steps.

In step S200B, a gray scale compensation parameter of two band points of each second sub-image area is obtained, according to the brightness information of the at least two band points of each second sub-image area and a reference brightness $L_0$.

In step S300B, a gray scale compensation information of each second sub-image area is obtained, according to the gray scale compensation parameter of the at least two band points. The gray scale compensation parameter of the at least two band points of each second sub-image area can be data-fitted by using a fitting method, so as to obtain respective gray scale compensation parameters for the second sub-image area. Step S200B and Step S200A may be executed simultaneously or sequentially. Step S300B and Step S300A may be executed simultaneously or sequentially.

For example, taken the 8-bit image as an example, the gray scale of each second sub-image area is between 0 and 255, and correspondingly has 256 gray scale compensation parameters. Each gray scale compensation parameter of the second sub-image area may constitute gray scale compensation information of the second sub-image area. There are various fitting methods, such as linear interpolation and other fitting methods. The obtained gray scale compensation information of each second sub-image area may be stored in the memory. The memory may be a storage device or a collective term for multiple storage elements, and is used to store executable program code and the like. The memory may comprise random access memory (RAM) or non-volatile memory (non-volatile memory), such as disk memory, flash memory (Flash), and so on.

Based on this, as shown in FIG. 8, after acquiring the image information, the above image processing method further comprises the following steps.

In step S600B, the gray scale compensation process is performed on the image information according to the gray scale compensation information of the N of second sub-image areas. Herein, the order of step S600B and step S600A may be executed simultaneously or sequentially, and may be set according to actual situation.

Figure 9:
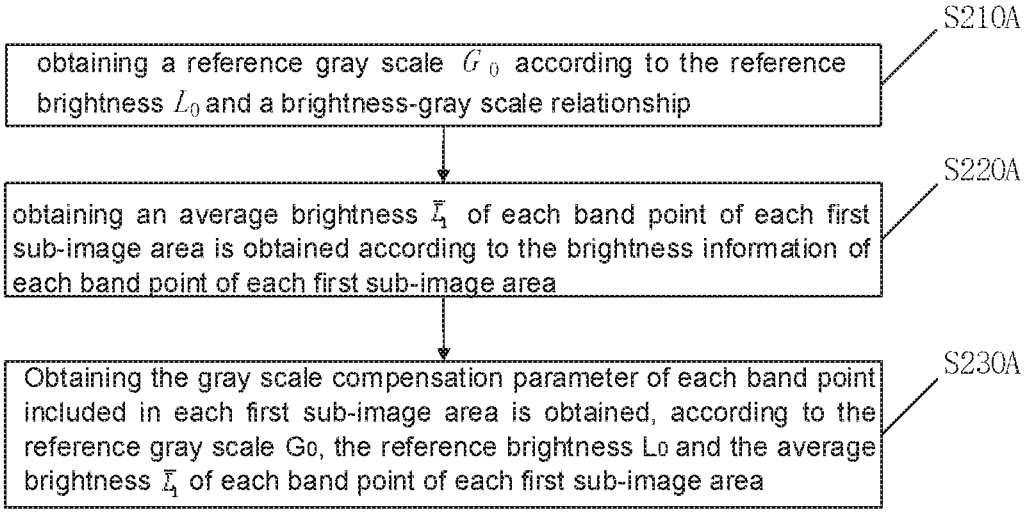
FIG. 9 shows a flowchart of another image processing method according to an embodiment of the present disclosure.

In some embodiments, as shown in FIG. 9, obtaining the gray scale compensation parameter of at least two band points included in each first sub-image area according to the brightness information of the at least two band points included in the brightness information of each first sub-image area and a reference brightness $L_0$ may comprise following steps.

In step S210A, a reference gray scale $G_0$ is obtained according to the reference brightness $L_0$ and a brightness-gray scale relationship. The brightness-gray scale relationship is $L=A*(G/255)^{Gamma}$, Gamma is the display parameter L is the brightness, and G is the gray scale.

In step S220A, an average brightness $\overline{L_1}$ of each band point of each first sub-image area is obtained according to the brightness information of each band point of each first sub-image area. Herein, each band point brightnesses included in the brightness information of each first sub-image area may be more than one. Thus, by using all of the brightnesses of one band point from the brightness information of the first sub-image area, the average brightness of the band point from the brightness information of the first sub-image area is obtained.

In step S230A, a gray scale compensation parameter of each band point included in each first sub-image area is obtained, according to the reference gray scale $G_0$, the reference brightness $L_0$ and the average brightness of each band point of each first sub-image area $\overline{L_1}$.

Figure 10:
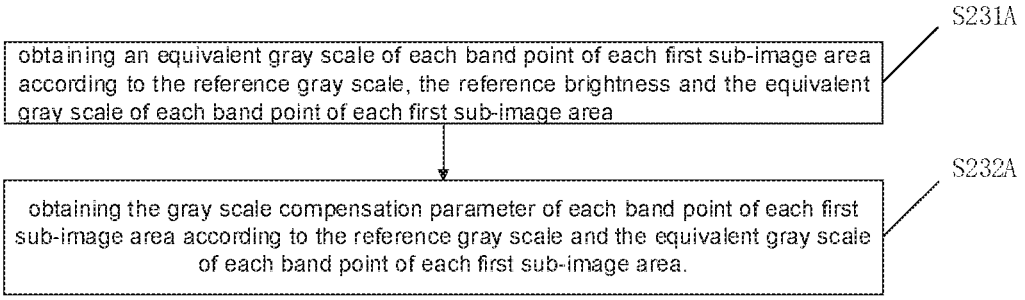
FIG. 10 shows a flowchart of another image processing method according to an embodiment of the present disclosure.

As shown in FIG. 10, obtaining the gray scale compensation parameter of each band point included in each first sub-image area according to the reference gray scale $G_0$, the reference brightness $L_0$ and the average brightness of each band point included in each first sub-image area $\overline{L_1}$ may comprise the following steps.

In step S231A, an equivalent gray scale $$G_1 = G_0 \times \text{Gamma} \times \sqrt{\frac{L_0}{\overline{L_1}}}$$

of each band point of each first sub-image area is obtained, according to the reference gray scale $G_0$, the reference brightness $L_0$ and the equivalent gray scale of each band point of each first sub-image area $\overline{L_1}$.

In step S232A, a gray scale compensation parameter $G_0$ of each band point of each first sub-image area is obtained, according to the reference gray scale $\Delta G_1$ and the equivalent gray scale $G_1$ of each band point of each first sub-image area. For each first sub-image area, the gray scale compensation parameter $$\Delta G_1 = \alpha * G_0\left(1 - \text{Gamma}*\sqrt{\frac{L_0}{\overline{L_1}}}\right)$$

of each band point of each first sub-image area, $\alpha$ is the first direction brightness modulation factor, $\alpha$ is greater than or equal to 0.5 but less than or equal to 1, and Gamma is the display parameter, for example, 2.2.

It can be explained that when both M and N are greater than or equal to 2, the first direction brightness modulation factor is related to the aspect ratio of the display panel and the degree of unevenness of the image brightness in the first direction, and is limited by gray scale compensation parameters in the second direction. Therefore, $\alpha$ can be adjusted between 0.5 and 1 according to the display effect of the gray scale compensated image. When M≥2 and N=0, it means that the above image brightness information does not comprise the brightness information of the N of second sub-image areas arranged along the second direction, therefore, there is no need to set the first direction brightness modulation factor, that is, $\alpha$=1, and there is no need to set $\alpha$.

It should be noted that, if M and N are both greater than or equal to 2, the gray scale compensation parameters of the image pixel is $\Delta G_{PIX}=\Delta G_{PIX1}+\Delta G_{PIX2}$, $\Delta G_{PIX1}$ is the gray scale compensation parameters of the pixels in the first direction, and $\Delta G_{PIX2}$ is the gray scale compensation parameters of the pixels in the second direction. In addition, when performing the image gray scale compensation, the pixels can be compensated by using the gray scale compensation parameters of the first direction and then using the gray scale compensation parameters of the second direction. Of course, the pixels can be compensated by using the gray scale compensation parameters of the second direction and then using the gray scale compensation parameters of the first direction.

Figure 11:
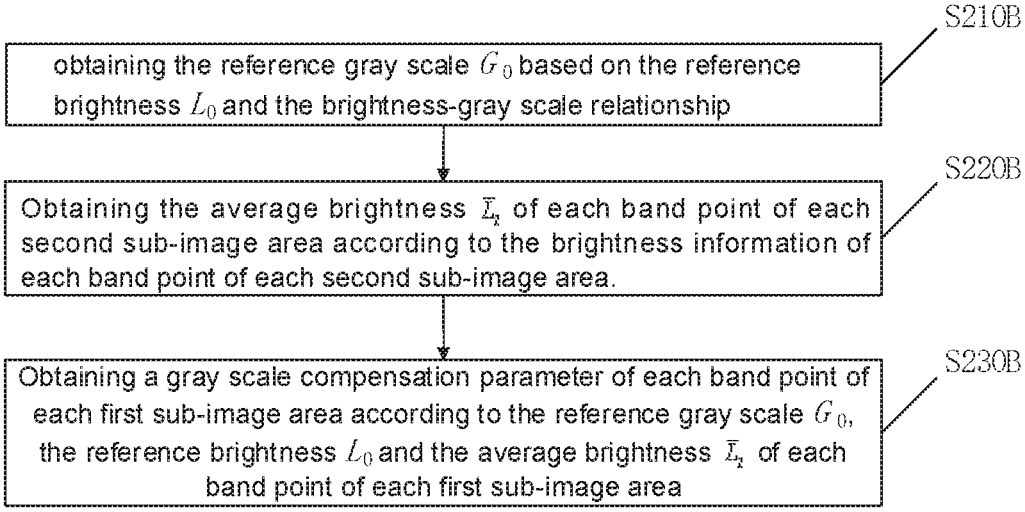
FIG. 11 shows a flowchart of another image processing method according to an embodiment of the present disclosure.

In some embodiments, as shown in FIG. 11, obtaining the gray scale compensation parameter of the at least two band points of each second sub-image area according to the brightness information of the at least two band points of each second sub-image area and the reference brightness $L_0$ may comprise following steps.

In step S210B, based on the reference brightness $L_0$ and the brightness-gray scale relationship, the reference gray scale $G_0$ is obtained.

In step S220B, the average brightness $\overline{L_2}$ of each band point of each second sub-image area is obtained according to the brightness information of each band point of each second sub-image area. Herein, each band point brightnesses of the brightness information of each second sub-image area may be more than one. Thus, by using all of the brightnesses of one band point of the second sub-image area, the average brightness of the band point of the second sub-image area is obtained.

In step S230B, a gray scale compensation parameter of each band point of each first sub-image area is obtained, according to the reference gray scale $G_0$, the reference brightness $L_0$ and the average brightness $\overline{L_2}$ of each band point of each first sub-image area.

Figure 12:
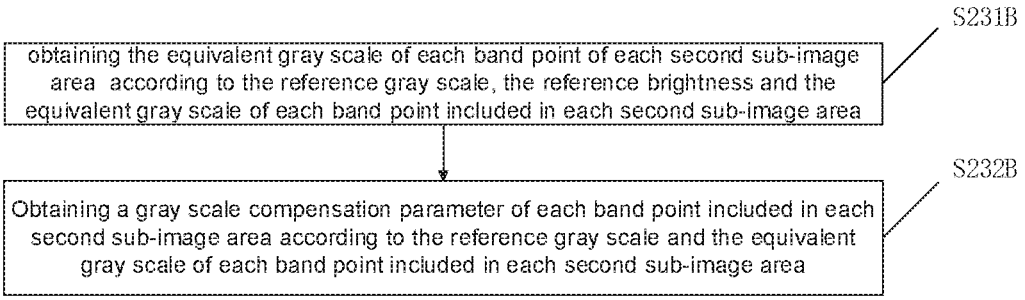
FIG. 12 shows a flowchart of another image processing method according to an embodiment of the present disclosure.

As shown in FIG. 12, obtaining the gray scale compensation parameter of each band point included in each second sub-image area according to the reference gray scale $G_0$, the reference brightness $L_0$ and the average brightness of each band point included in each second sub-image area $\overline{L_2}$ may comprise the following steps.

In step S231B, an equivalent gray scale $$G_2 = G_0 \times \text{Gamma}\times\sqrt{\frac{L_0}{\overline{L_2}}}$$

of each band point of each second sub-image area is obtained, according to the reference gray scale $G_0$, the reference brightness $L_0$ and the equivalent gray scale of each band point included in each second sub-image area $\overline{L_2}$.

In step S232B, a gray scale compensation parameter $G_0$ of each band point included in each second sub-image area is obtained, according to the reference gray scale $\Delta G_2$ and the equivalent gray scale $G_2$ of each band point included in each second sub-image area. For each second sub-image area, the gray scale compensation parameter $$\Delta G_2 = \beta * G_0\left(1 - \text{Gamma}*\sqrt{\frac{L_0}{\overline{L_2}}}\right)$$

of each band point included in each second sub-image area, $\beta$ is greater than or equal to 0.5 but less than or equal to 1.

Herein, it can be explained that when both M and N are greater than or equal to 2, the first direction brightness modulation factor is related to the aspect ratio of the display panel and the degree of unevenness of the image brightness in the first direction, and is limited by gray scale compensation parameters in the second direction. Therefore, $\beta$ can be adjusted between 0.5 and 1 according to the display effect of the gray scale compensated image. When N≥2 and M=0, it means that the above image brightness information does not comprise the brightness information of the M of first sub-image areas arranged along the first direction, therefore, there is no need to set the first direction brightness modulation factor, that is, $\beta$=1, and there is no need to set $\beta$.

When the above image brightness information comprises both the brightness information of the M of first sub-image areas arranged along the first direction and the brightness information of the N of second sub-image areas arranged along the second direction, the display device is divided into M of first display areas along the first direction, and the brightness information of the M of first sub-image areas arranged along the first direction are collected. The display device is divided into N of second display areas along the second direction, and the brightness information of the N of second sub-image areas arranged along the second direction are collected.

When the above image brightness information comprises both the brightness information of the M of first sub-image areas arranged along the first direction and the brightness information of the N of second sub-image areas arranged along the second direction, it is also possible to divide the display device into M of first display areas along the first direction, divide the display device into N of second display areas along the second direction, and then collect the brightness information of the M of the first sub-image area arranged along the first direction and the brightness information of the N of second sub-image areas arranged along the second direction in one time. The image brightness information collection method is more convenient, and does not require multiple collection, which is simple and convenient. Since the first direction and the second direction are different, the display device is divided into a grid display area after completing the division, the corresponding M of first sub-image areas and N of second sub-image areas form a grid sub-image areas.

In some embodiments, the above-mentioned reference brightness $L_0$ may be a default, or may be selected from the average brightness of the first sub-image area, that is, the above-mentioned reference brightness $L_0$ is the average brightness of each band point of a target first sub-image area, and the first direction is the same as the direction away from the signal generation chip. Since the IR voltage drop is small, the brightness of the first sub-image area close to the signal generation chip may be high. If the average brightness of the first sub-image areas is used as the reference brightness $L_0$, this will result in a large amount of processing for gray scale compensation. Based on this, the target first sub-image area is the $k^{th}$ first sub-image area along the direction away from the signal generation chip, wherein k is an integer greater than or equal to 2 and less than or equal to M. As for the value of k, it can be set according to the reference brightness $L_0$. For example, when M is an even number, the target first sub-image area may be set to the $M/2^{th}$ first sub-image area. For another example, when M is an odd number, the target first sub-image area may be set to the $(M+1)/2^{th}$ first sub-image area.

Figure 13:
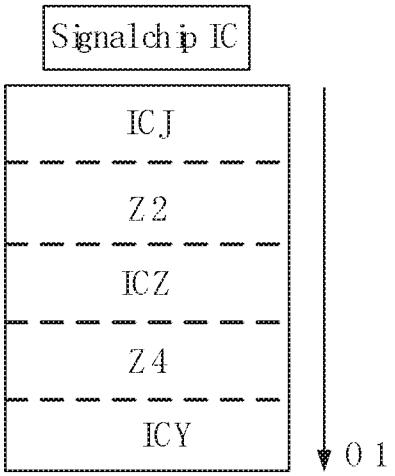
FIG. 13 shows a schematic diagram of an arrangement of sub-image areas along a first direction according to an embodiment of the present disclosure.
Figure 15:
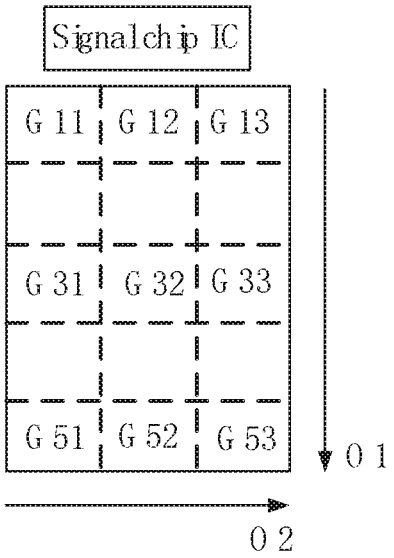
FIG. 15 shows a schematic diagram of an arrangement of grid sub-image areas according to an embodiment of the present disclosure.

FIG. 13 shows a schematic diagram of an arrangement of sub-image areas along the first direction. FIG. 15 shows a schematic diagram of an arrangement of a grid sub-image areas. It can be seen from FIGS. 13 and 15 that there are 3 first sub-image areas and 2 intermediate sub-image areas along the first direction. As shown in FIG. 15, the formed grid sub-image area is a 5×3 grid display area.

Exemplarily, FIG. 13 shows a schematic diagram of an arrangement having 5 sub-image areas along the first direction. As shown in FIG. 13, the 5 sub-image areas along the first direction comprise the first vertical sub-image area Z1, the second vertical sub-image area Z2, the third vertical sub-image area Z3, the fourth vertical sub-image area Z4 and the fifth vertical sub-image area Z5. The first vertical sub-image area, the third vertical sub-image area, and the fifth vertical sub-image area are all first sub-image areas; and the second vertical sub-image area and the fourth vertical sub-image area are all intermediate sub-image areas.

The first longitudinal sub-image area is defined as a chip proximal image area ICJ, a chip intermediate image area ICZ, and a chip distal image area ICY. When collecting the image brightness information, the display device displays an image with the same band point, and uses the light collection device to collect the brightness information of the chip proximal image area ICJ, the brightness information of the chip intermediate image area ICZ, and the brightness information of the chip distal image area ICY of the corresponding band point, wherein the average brightness obtained from the brightness information of the chip intermediate image area ICZ is defined as the reference brightness L0 of the current band point. Then, the image information of the next band point is displayed, and the light collection device is used to collect the brightness information of the chip proximal image area ICJ, the brightness information of the chip intermediate image area ICZ, and the brightness information of the chip distal image area ICY of this band point. The above process is repeated, and the brightness information of the chip proximal image area ICJ, the brightness information of the chip intermediate image area ICZ, and the brightness information of the chip distal image area ICY of the desired number of band points are collected, wherein the average brightness obtained from the brightness information of the chip intermediate image area ICZ is defined as the reference brightness L0 of the current band point.

Figure 14:
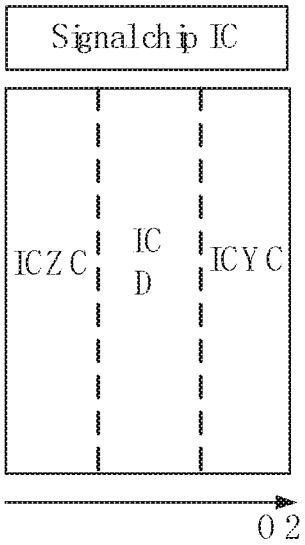
FIG. 14 shows a schematic diagram of an arrangement of sub-image areas along a second direction according to an embodiment of the present disclosure.

Exemplarily, FIG. 14 shows a schematic diagram of an arrangement of sub-image areas along the second direction. As shown in FIG. 14, the sub-image area along the second direction comprises a first horizontal sub-image area, a second horizontal sub-image area, and a third horizontal sub-image area. The first horizontal sub-image area, the second horizontal sub-image area, and the third horizontal sub-image area all belong to the second sub-image area.

The first horizontal sub-image area is defined as the chip left image area ICZC, the second horizontal sub-image area is defined as the chip corresponding image area ICD, and the third horizontal sub-image area is defined as the chip right image area ICYC. When collecting the image brightness information, the display device displays the image information of the next band point, and use the light collection device to collect the brightness information of the chip left image area ICZC, the brightness information of the chip corresponding image area ICD, and the brightness information of the chip right image area ICYC of this band point. Then, the image information of the next band point is displayed, the display device displays the image information of the next band point, and use the light collection device to collect the brightness information of the chip left image area ICZC, the brightness information of the chip corresponding image area ICD, and the brightness information of the chip right image area ICYC of this band point. The above process is repeated, and the brightness information of the chip left image area ICZC, the brightness information of the chip corresponding image area ICD, and the brightness information of the chip right image area ICYC of the desired number of band points are collected.

The band point comprised in the brightness information of the second sub-image areas along the second direction may be the same as the band point comprised in the brightness information of the first sub-image areas along the first direction.

For example, FIG. 15 shows a schematic diagram of an arrangement of a grid sub-image areas. As shown in FIG. 15, the grid sub-image areas comprises 15 sub-image areas, and the 9 sub-image areas shown in FIG. 15 are areas that require brightness collection. The 9 sub-image areas are defined as the sub-image area G11 in the first row and first column, the sub-image area G12 in the first row and second column, the sub-image area G13 in the first row and third column, the sub-image area G31 in the third row and first column, the sub-image area G32 in the third row and second column, the sub-image area G33 in the third row and third column, the sub-image area G51 in the fifth row first column, the sub-image area G52 in the fifth row second column, and the sub-image area G53 in the fifth row third column.

For example, the sub-image area G11 in the first row and first column, the sub-image area G12 in the first row and second column, and the sub-image area G13 in the first row and third column along the first direction are divided into the chip proximal image area ICJ shown in FIG. 13. The sub-image area G31 in the third row and first column, the sub-image area G32 in the third row and second column, and the sub-image area G33 in the third row and third column along the first direction are divided into the chip intermediate image area ICZ shown in FIG. 13. The sub-image area G51 in the fifth row and first column, the sub-image area G52 in the fifth row and second column, and the sub-image area G53 in the fifth row and third column along the first direction are divided into the chip distal image area ICY shown in FIG. 13.

As shown in FIG. 15, when collecting image brightness information, the display device displays the image of one band point, and uses the light collection device to collect the brightness information of the sub-image area G11 in the first row and first column, the sub-image area G12 in the first row and second column and the sub-image area G13 in the first row and third column included in the chip proximal image area ICJ; the brightness information of the sub-image area G31 in the third row and first column, the sub-image area G32 in third row and second column and the sub-image area G33 in the third row and third column included in the chip intermediate image area ICZ; and the brightness information of the sub-image area G51 in the fifth row and first column, the sub-image area G52 in fifth row and second column and the sub-image area G53 in fifth row and third column included in the chip distal image area ICY of the one band point. Then, the image of the next band point is displayed. The light collection device is used to collect the brightness information of the sub-image area G11 in the first row and first column, the sub-image area G12 in the first row and second column and the sub-image area G13 in the first row and third column included in the chip proximal image area ICJ; the brightness information of the sub-image area G31 in the third row and first column, the sub-image area G32 in third row and second column and the sub-image area G33 in the third row and third column included in the chip intermediate image area ICZ; and the brightness information of the sub-image area G51 in the fifth row and first column, the sub-image area G52 in fifth row and second column, and the sub-image area G53 in the fifth row and third column included in the chip distal image area ICY of this band point. By repeating the above processes, the brightness information of the sub-image area G11 in the first row and first column, the sub-image area G12 in the first row and second column and the sub-image area G13 in the first row and third column included in the chip proximal image area ICJ; the brightness information of the sub-image area G31 in the third row and first column, the sub-image area G32 in third row and second column and the sub-image area G33 in the third row and third column included in the chip intermediate image area ICZ; and the brightness information of the sub-image area G51 in the fifth row and first column, the sub-image area G52 in fifth row and second fifth column and the sub-image area G53 in fifth row and third fifth column included in the chip distal image area ICY of the desired number of band points are collected.

As shown in FIG. 15, the sub-image area G11 in the first row and first column, the sub-image area G31 in the third row and first column, and the sub-image area G51 in the third row and first column along the second direction are divided into the chip left image area ICZC shown in FIG. 14. The sub-image area G12 in the first row and second column, the sub-image area G32 in the third row and second column, and the sub-image area G52 in the third row and second column along the second direction are divided into the chip corresponding image area ICD shown in FIG. 14. The sub-image area G13 in the first row and third column, the sub-image area G33 in the third row and third column, and the sub-image area G53 in the third row and second column along the third direction are divided into the chip right image area ICYC shown in FIG. 14.

As shown in FIG. 15, when collecting image brightness information, the display device displays the image of one band point, and uses the light collection device to collect the brightness information of the sub-image area G11 in the first row and first column, the sub-image area G31 in the third row and first column and the sub-image area G51 in the fifth row and first column included in the chip left image area ICZC; the brightness information of the sub-image area G12 in the first row and second column, the sub-image area G32 in third row and second column and the sub-image area G52 in the fifth row and second column included in the chip corresponding image area ICD; and the brightness information of the sub-image area G13 in the first row and third column, the sub-image area G33 in the third row and third fifth column and the sub-image area G53 in the fifth row and third fifth column included in the chip right image area ICYC of this band point. Then, the image of the next band point is displayed. The light collection device is used to collect the brightness information of the sub-image area G11 in the first row and first column, the sub-image area G31 in the third row and first column and the sub-image area G51 in the fifth row and first column included in the chip left image area ICZC; the brightness information of the sub-image area G12 in the first row and second column, the sub-image area G32 in third row and second column and the sub-image area G52 in the fifth row and second column included in the chip corresponding image area ICD; and the brightness information of the sub-image area G13 in the first row and third column, the sub-image area G33 in third row and third column, and the sub-image area G53 in the fifth row and third column included in the chip right image area ICYC of this band point.

In some embodiments, as shown in FIG. 8, in order to simplify image processing, after receiving the image information, the above image processing method further comprises the following steps.

In step 500A, the gray scale compensation process is performed on the image information according to the gray scale compensation information of the M of first sub-image areas, and the gray scale compensation process is performed on the image information according to the gray scale compensation information of the N of second sub-image areas, in response to an average gray scale of at least one primary color included the image information being greater than the gray scale threshold of the corresponding primary color.

Figure 16:
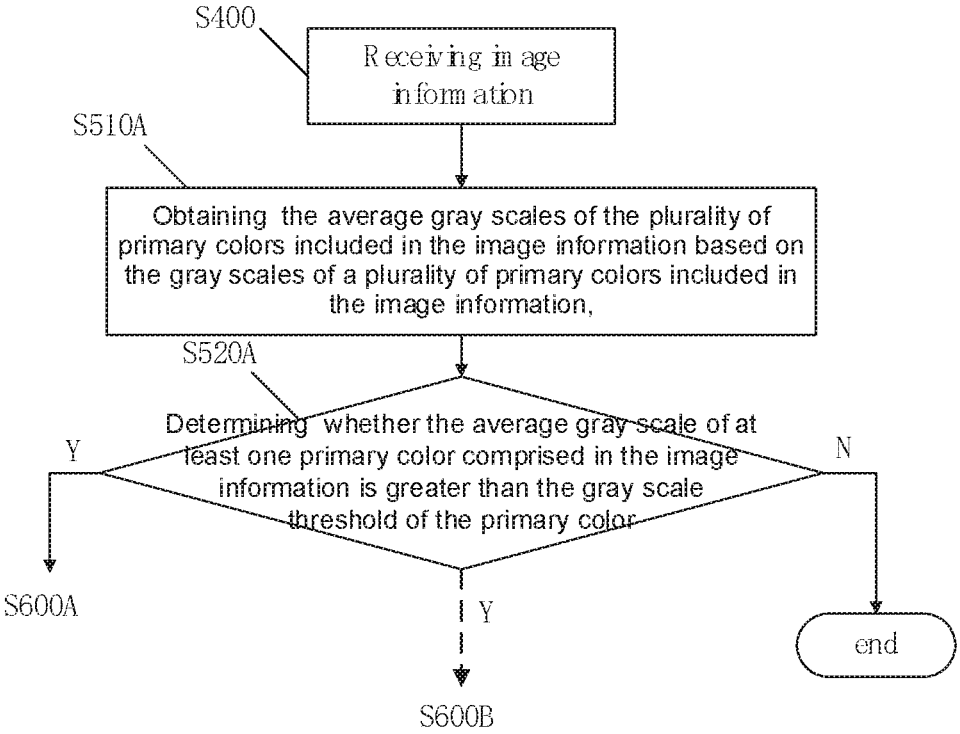
FIG. 16 shows a flowchart of a pixel processing method according to an embodiment of the present disclosure.

For example, as shown in FIG. 16, after receiving the image information, the above image processing method further comprises the following steps.

In step S510A, based on the gray scales of a plurality of primary colors included in the image information, the average gray scales of the plurality of primary colors included in the image information are obtained.

In step S520A, it is determined whether the average gray scale of at least one primary color comprised in the image information is greater than the gray scale threshold of the primary color.

If yes, step S600A or step S600B is executed. Otherwise, the image process ends.

For example, if the pixels comprised in the display device are divided into red pixels for displaying red, green pixels for displaying green, and blue pixels for displaying blue, then the red average gray scale comprised in the image information can be obtained according to the gray scale values displayed by all red pixels comprised in the image information; the green average gray scale comprised in the image information can be obtained according to the gray scale values displayed by all green pixels comprised in the image information; and the blue average gray scale comprised in the image information can be obtained according to the gray scale values displayed by all blue pixels comprised in the image information.

When the red average gray scale comprised in the image information is less than the red gray scale threshold, the green average gray scale comprised in the image information is less than the green gray scale threshold, or the blue average gray scale comprised in the image information is less than the blue gray scale threshold, it is showed that the brightness of this color in the image is relatively low, and the image is a low gray scale image. Since the display panel displays the low gray scale image with a small difference in brightness, and the human eye is not sensitive to the low brightness image, the primary color in the image information is no longer compensated. Otherwise, step S600A or step S600B is executed.

In some embodiments, the image brightness information comprises the brightness information of the plurality of primary color images and white image brightness information.

The corresponding gray scale compensation information of each first sub-image area comprises the gray scale compensation information of each first sub-image area corresponding to the brightness information of plurality of primary color images and the gray scale compensation information of each first sub-image area corresponding to white image brightness information. The gray scale compensation information of each first sub-image area corresponding to the brightness information of the plurality of primary color images and the gray scale compensation information of each first sub-image area corresponding to white image brightness information can be obtained with reference to the above discussion.

The gray scale compensation information of each first sub-image area further comprises the gray scale compensation information of each second sub-image area corresponding to the brightness information of the plurality of primary color images and the gray scale compensation information of each second sub-image area corresponding to white image brightness information. The gray scale compensation information of each second sub-image area corresponding to the brightness information of the plurality of primary color images and the gray scale compensation information of each second sub-image area corresponding to white image brightness information can be obtained with reference to the above discussion.

The white light compensation method is used to compensate the gray scale image, which requires fewer compensation parameters and occupies less storage space. The IR pressure drop compensation of the gray scale image will not cause color cast. However, if the white light compensation method is used to further perform gray scale compensation on the color image, there will result in a color cast problem.

Figure 17:
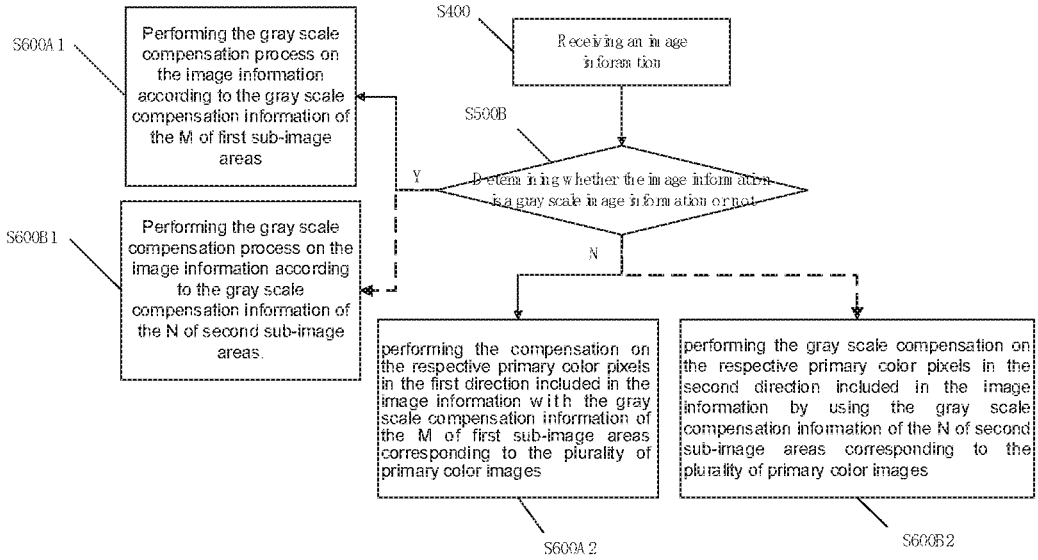
FIG. 17 shows a flowchart of a pixel processing method according to an embodiment of the present disclosure.

In order to reduce the color cast problem caused by the pixel compensation, before performing the gray scale compensation process on the image information according to the gray scale compensation information of the M of first sub-image areas and after the image information, as shown in FIG. 17, the above image process may further comprise following steps:

In step S500B, it is determined whether the image information is the gray scale information of the gray scale image.

Figure 18:
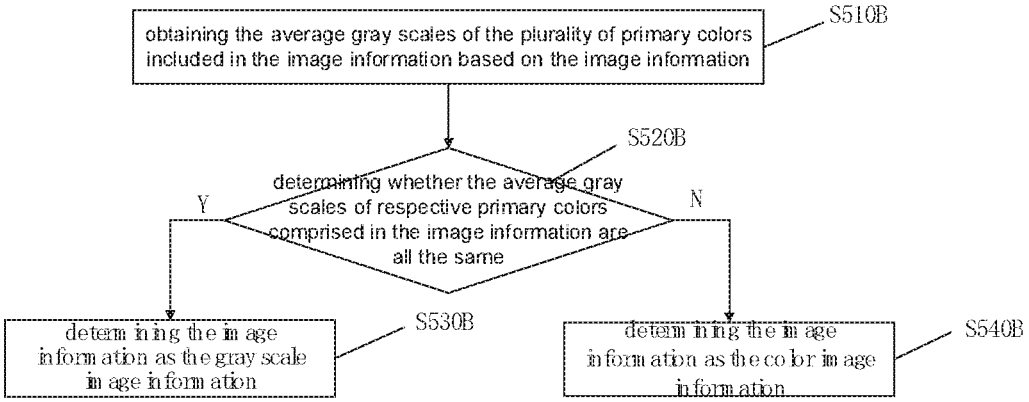
FIG. 18 shows a flowchart of a pixel processing method according to an embodiment of the present disclosure.

For example, as shown in FIG. 18, determining whether the image information is the gray scale image information may comprise the following steps.

In step S510B, based on the image information, the average gray scales of the plurality of primary colors included in the image information are obtained.

In step S520B, it is determined whether the average gray scales of respective primary colors comprised in the image information are all the same.

If they are the same, step S530B is executed; otherwise, step S540B is executed.

In step S530B, it is determined that the image information is the gray scale information. In step S540B, it is determined that the image information is the color scale information.

For example, if the image information comprises a plurality of red pixel gray scales, a plurality of green pixel gray scales, and a plurality of blue pixel gray scales, then the average gray scale of the red pixels comprised in the image information may be obtained according to the plurality of red pixel gray scales comprised in the image information. The average gray scale of green pixels comprised in the image information is obtained according to the plurality of green pixels comprised in the image information, and the average gray scale of blue pixels comprised in the image information is obtained according to the plurality of blue pixels comprised in the image information. Then, it is determined whether the average gray scales of the red pixels, the average gray scales of the green pixels and the average gray scales of the blue pixels comprised in the image information are all the same. If they are the same, the image information is determined to be the gray scale image information, otherwise the image information is the color image information.

As shown in FIG. 17, if the image information is the gray scale image information, step S600A1 or step S600B1 is executed.

Step S600A1 comprises performing the gray scale compensation on the respective primary pixels in the first direction included in the image information by using the gray scale compensation information of the M of first sub-image areas corresponding to the white image.

Step S600B1 comprises performing the gray scale compensation on the respective primary pixels in the second direction included in the image information by using the gray scale compensation information of the N of second sub-image areas corresponding to the white image.

When the image information is the gray scale image information, the gray scale compensation method for the gray scale image is the white light compensation method. Since in the white light compensation method, the sub-image areas (such as the first sub-image area and/or the second sub-image area) corresponding to the red pixels, the green pixels and the blue pixels included in the white image, the gray scale compensation process is performed on the gray scale image with the white light compensation method, which will not result in a color cast problem of the gray scale image.

As shown in FIG. 17, if the image information is the color scale image information, step S600A2 or step S600B2 is executed.

Step S600A2 comprises performing the gray scale compensation on the respective primary color pixels in the first direction included in the image information by using the gray scale compensation information of the M of first sub-image areas corresponding to the plurality of primary color images.

Step S600B2 comprises performing the gray scale compensation on the respective primary color pixels in the second direction included in the image information by using the gray scale compensation information of the N of second sub-image areas corresponding to the plurality of primary color images.

Thus, when the image information is the color scale image information, the gray scale compensation method for the color image is the primary color compensation method. That is, the gray scale of the corresponding primary color pixels of the color image is compensated with the gray scale compensation information of the corresponding sub-area region (such as, at least one of the first sub-image area and the second sub-image area) of the primary color image.

It should be noted that if the image processing method according to the embodiment of the present disclosure comprises not only step S500A but also step S500B, then steps S500B and S500A may be executed in a random order. For example, after performing step S500B, step S500A is performed, and then step S600A1 or step S600B1 is performed. For another example, after performing step S500A, step S500B is performed, and then step S600A1 or step S600B1 is performed.

Figure 19:
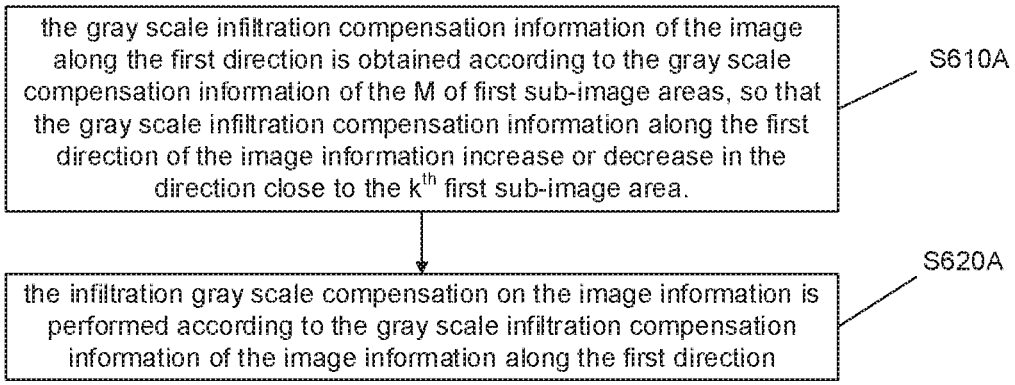
FIG. 19 shows a flowchart of a pixel processing method according to an embodiment of the present disclosure.

In some embodiments, the gray scale compensation information of each first sub-image area discussed above is obtained according to the brightness information of the M of first sub-image areas arranged in the first direction. Thus, when the difference between the gray scale compensation information of two neighbor first sub-image areas is relatively large, it is easy to generate stripes along the direction perpendicular to the first direction on the compensated image information. If the first direction is the length direction of the display device, the generated stripes are cross stripes along the width direction. Thus, a gray scale infiltration algorithm can be used to compensate the gray scale of the pixels along the first direction of the image information. For example, as shown in FIG. 19, performing the gray scale compensation process on the image information according to the gray scale compensation information of the M of first sub-image areas may comprise following steps.

In Step S610A, the gray scale infiltration compensation information of the image along the first direction is obtained according to the gray scale compensation information of the M of first sub-image areas, so that the gray scale infiltration compensation information along the first direction of the image information increase or decrease in the direction close to the $k^{th}$ first sub-image area. With respect to the schematic diagram of the arrangement of the sub-image areas along the first direction shown in FIG. 13, the gray scale infiltration compensation information of the image information along the first direction gradually increases along the direction from the chip proximal image area to the chip intermediate image area, and the gray scale infiltration compensation information of the image information along the first direction gradually decreases along the direction from the chip distal image area to the chip intermediate image area. The chip proximal image area refers to an image area close to the signal generation chip, the chip intermediate image area refers to an image area having an appropriate distance from the signal generation chip, and the distal image area refers to an image area far from the signal generation chip.

In step S620A, the infiltration gray scale compensation on the image information is performed according to the gray scale infiltration compensation information of the image information along the first direction.

For example, FIG. 13 shows a schematic diagram of an arrangement of sub-image areas along the first direction. The first sub-image area and its corresponding definition refer to the foregoing. When the first direction is the direction far from the signal generation chip, due to the IR voltage drop, the brightness of the image displayed by the display device gradually decreases along the direction far from the signal generation chip. If the average brightness of the band points comprised in the brightness information of the chip intermediate image area ICZ is the reference brightness, the brightness of the chip proximal image area ICJ is relatively high, and the brightness of the chip distal image area ICY is relatively low. If the gray scale compensation is performed on all the pixels comprised in the chip proximal image area ICJ and a intermediate sub-image area adjacent to the chip intermediate image area ICZ, it is easy to result in a poor transitivity between the compensated brightness of the chip proximal image area ICJ and the brightness of the chip intermediate image area ICZ, thereby generating the stripes. For the same reason, the transitivity between the compensated brightness of the chip distal image area ICY and the brightness of the chip intermediate image area ICZ is poor, thereby generating the stripes.

Using gray scale infiltration algorithm to compensate the gray scale of the pixels along the first direction of the image information comprises:

acquiring the number NPIX of rows of pixels from the chip intermediate image area ICZ to the edge of the chip proximal image area according to the pixel area information of the chip intermediate image area ICZ and the pixel area information of the chip proximal image area, i.e. NPIX=65−1=64.

If the chip proximal image area has its gray scale compensation parameter of −8 in a gray scale interval from 246 to 251, since the reference brightness is the average brightness of each band point of the chip intermediate image area ICZ, the chip intermediate image area has its gray scale compensation parameter of 0 in the gray scale interval from 246 to 251. Based on this, the difference between the gray scale compensation parameters of the chip proximal image area is obtained according to the gray scale compensation parameters of the chip proximal image area in the gray scale interval from 246 to 251 and the chip intermediate image area in the gray scale interval from 246 to 251, $\Delta k=-8-0=-8$.

According to the difference between the chip proximal gray scale compensation parameters $\Delta k$ and the number of pixels NPIX from the chip intermediate image area ICZ to the chip proximal image area edge in the first direction, the number of rows of pixels occupied by the unit gray scale compensation difference is obtained, n=8.

In the following, by taking the gray scale compensation information of every two rows of pixels changing once as an example, the gray scale compensation parameters (that is, gray scale infiltration compensation parameters) of the chip intermediate image area ICZ to the chip proximal image area ICJ in the gray scale interval of 246 to 251 are illustrated. The method for setting the gray scale compensation parameters of the chip intermediate image area ICZ to the chip distal image area ICY in the gray scale interval from 246 to 251 can refer to the method for setting the gray scale compensation parameters of the chip intermediate image area ICZ to the chip proximal image area ICJ in the gray scale interval from 246 to 251.

For the pixels in the $64^{th}$ row to the $57^{th}$ row, the pixels in the $64^{th}$ row to the $57^{th}$ row constitute the first-level gray scale compensation area. The first-level gray scale compensation area is divided into the $1^{st}$ first-level gray scale compensation area, the $2^{nd}$ first-level gray scale compensation area, the $3^{rd}$ first-level gray scale compensation area, and the $4^{th}$ first-level gray scale compensation area along the direction far from the chip intermediate image area ICZ.

The pixels in the $64^{th}$ row and the pixels in the $63^{rd}$ row constitute a $1^{st}$ first-level gray scale compensation area. 25% of the pixels in the $1^{st}$ first-level gray scale compensation area is selected to be compensated in the gray scale term with the gray scale compensation parameter of −1, while 75% of the pixels are not going to be compensated for gray scale, or in other words, to be compensated in the gray scale term with the gray scale compensation parameter of 0. The pixels in the $62^{nd}$ row and the pixels in the $61^{st}$ row constitute a $2^{nd}$ first-level gray scale compensation area. 50% of the pixels in the $2^{nd}$ first-level gray scale compensation area is selected to be compensated in the gray scale term with the gray scale compensation parameter of −1, while 50% of the pixels are not going to be compensated for gray scale, or in other words, to be compensated in the gray scale term with the gray scale compensation parameter of 0. The pixels in the $60^{th}$ row and the pixels in the $59^{nd}$ row constitute a $3^{rd}$ first-level gray scale compensation area. 75% of the pixels in the $3^{rd}$ first-level gray scale compensation area is selected to be compensated in the gray scale term with the gray scale compensation parameter of −1, while 25% of the pixels are not going to be compensated for gray scale, or in other words, to be compensated in the gray scale term with the gray scale compensation parameter of 0. The pixels in the $58^{th}$ row and the pixels in the $57^{rd}$ row constitute a $4^{th}$ first-level gray scale compensation area. All or 100% of the pixels in the $4^{th}$ first-level gray scale compensation area are selected to be compensated in the gray scale term with the gray scale compensation parameter of −1. For each first-level gray scale compensation area, the selection of pixels in which the gray scale compensation is performed with the gray scale compensation parameter of −1 can follow the principle of an uniform arrangement, so as to ensure the uniformity of the gray scale of the pixels after the gray scale compensation. Since each first-level gray scale compensation area comprises two rows of pixels, in each first-level gray scale compensation area, the pixels for which the gray scale compensation is performed with the gray scale compensation parameter of −1 are arranged at intervals in each row of pixels. The pixels in the adjacent two rows of pixels for which the gray scale compensation is performed with the gray scale compensation parameter of −1 are staggered.

For the pixels in the $56^{th}$ row to the $49^{th}$ row, the pixels in the $56^{th}$ row to the $49^{th}$ row constitute a second-level gray scale compensation area. The second-level gray scale compensation area is divided into the $1^{st}$ first-level gray scale compensation area, the $2^{nd}$ first-level gray scale compensation area, the $3^{nd}$ first-level gray scale compensation area, and the $4^{th}$ first-level gray scale compensation area along the direction far from the chip intermediate image area ICZ.

The pixels in the $56^{th}$ row and the pixels in the $55^{th}$ row constitute a $1^{st}$ second-level gray scale compensation area. 25% of the pixels in the $1^{st}$ second-level gray scale compensation area is selected to be compensated in the gray scale term with the gray scale compensation parameter of −2, while the remaining 75% of the pixels are compensated in the gray scale term with the gray scale compensation parameter of −1. The pixels in the $54^{th}$ row and the pixels in the $53^{rd}$ row constitute a $2^{nd}$ second-level gray scale compensation area. 50% of the pixels in the $2^{nd}$ second-level gray scale compensation area is selected to be compensated in the gray scale term with the gray scale compensation parameter of −2, while the remaining 50% of the pixels are compensated in the gray scale term with the gray scale compensation parameter of −1. The pixels in the $52^{nd}$ row and the pixels in the $51^{st}$ row constitute a $3^{rd}$ second-level gray scale compensation area. 75% of the pixels in the $3^{rd}$ second-level gray scale compensation area is selected to be compensated in the gray scale term with the gray scale compensation parameter of −2, while the remaining 25% of the pixels are compensated in the gray scale term with the gray scale compensation parameter of −1. The pixels in the $50^{th}$ row and the pixels in the $49^{th}$ row constitute a $4^{th}$ second-level gray scale compensation area. All or 100% of the pixels in the $4^{th}$ second-level gray scale compensation area are selected to be compensated in the gray scale term with the gray scale compensation parameter of −2. For each second-level gray scale compensation area, the principle of selecting pixels that are gray-scale compensated with the gray scale compensation parameter of −2 can refer to the principle of selecting pixels that are gray-scale compensated with the gray scale compensation parameter of −1, so as to ensure the uniformity of the gray scale of the pixels after the gray scale compensation.

The gray scale compensation parameters of the pixels in the $48^{th}$ row to the $41^{st}$ row, the gray scale compensation parameters for the pixels in the $33^{nd}$ row to the $40^{th}$ row, the selection of the gray scale compensation parameters for the pixels in the $25^{th}$ row to the $32^{nd}$ row, the gray scale compensation parameters of the pixels in the $17^{th}$ row to the $24^{th}$ row, and the gray scale compensation parameters of the pixels in the $9^{th}$ row to the $1^{st}$ row can be selected according to the method for selecting the gray scale compensation parameters of the pixels in the $56^{th}$ row to the $55^{th}$ row.

In some embodiments, since the gray scale compensation information of each second sub-image area discussed above being obtained according to the brightness information of the N of second sub-image areas arranged in the second direction, when the difference between the gray scale compensation information of two neighbor second sub-image areas is relatively large, it is easy to generate longitudinal stripes along the direction perpendicular to the second direction on the compensated image information. If the second direction is the width direction of the display device, the generated stripes are longitudinal stripes along the length direction. Thus, a gray scale infiltration algorithm can be used to compensate the gray scale of the pixels of the plurality of second sub-image areas arranged along the second direction of the image information.

Figure 20:
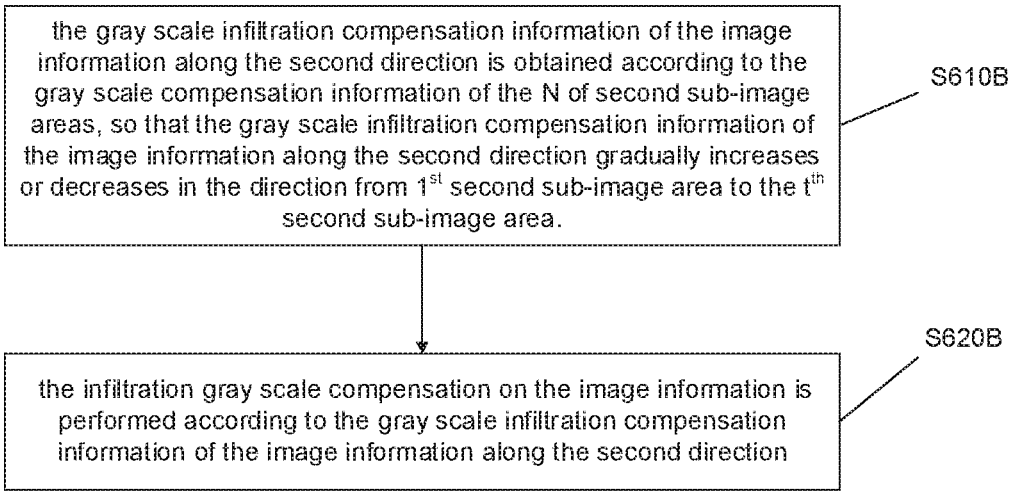
FIG. 20 shows a flowchart of a pixel processing method according to an embodiment of the present disclosure.

For example, as shown in FIG. 20, performing the gray scale compensation process on the image information according to the gray scale compensation information of the N of second sub-image areas may comprise following steps.

In step S610B, the gray scale infiltration compensation information of the image information along the second direction is obtained according to the gray scale compensation information of the N of second sub-image areas, so that the gray scale infiltration compensation information of the image information along the second direction gradually increases or decreases in the direction from $1^{st}$ second sub-image area to the $t^{th}$ second sub-image area. The $k^{th}$ first sub-image area has a geometric center positioned in the $t^{th}$ second sub-image area. With respect to the schematic diagram of the arrangement of the sub-image areas along the second direction shown in FIG. 14, the gray scale infiltration compensation information of the image information along the second direction gradually increases along the direction from the chip left image area ICZC to the chip corresponding image area ICD, and the gray scale infiltration compensation information of the image information along the second direction gradually decreases along the direction from the chip right image area ICYC to the chip corresponding image area ICD.

In step S620B, the infiltration gray scale compensation on the image information is performed according to the gray scale infiltration compensation information of the image information along the second direction.

For example, FIG. 14 shows a schematic diagram of an arrangement of sub-image areas along the second direction. The second sub-image area and its corresponding definition refer to the foregoing. If there is another signal generation chip in the second direction, when the second direction is the direction far from the signal generation chip, due to the IR voltage drop, the brightness of the image displayed by the display device gradually decreases along the direction far from the signal generation chip. That is, the brightness of the chip right image area ICYC is relatively low and the brightness of the chip corresponding image area ICD is the highest. In FIG. 13, the geometric center of the chip intermediate image area ICZ is located in the chip corresponding image area ICD shown in FIG. 14, then the average brightness of the band points comprised in the brightness information of the chip intermediate image area ICZ is used as the reference brightness. If the gray scale compensation is performed on all the pixels comprised in the chip left image area ICZC, it is easy to result in a poor transitivity between the compensated brightness of the chip left image area ICZC and the brightness of the chip corresponding image area ICD, thereby generating the stripes. For the same reason, the transitivity between the compensated brightness of the chip right image area ICYC and the brightness of the chip corresponding image area ICD is poor, thereby generating the stripes.

For example, the method for setting the gray scale compensation parameters of the chip left image area ICZC to the chip corresponding image area ICD in the gray scale interval from 246 to 251 can refer to the method for setting the gray scale compensation parameters of the chip intermediate image area ICZ to the chip proximal image area ICJ in the gray scale interval from 246 to 251. The method for setting the gray scale compensation parameters of the chip right image area ICYC to the chip corresponding image area ICD in the gray scale interval from 246 to 251 can refer to the method for setting the gray scale compensation parameters of the chip intermediate image area ICZ to the chip proximal image area ICJ in the gray scale interval from 246 to 251.

Figure 21:
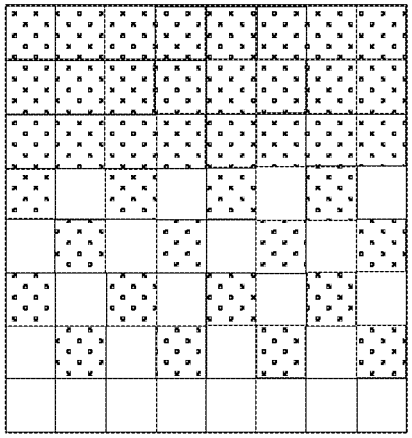
FIG. 21 shows a schematic diagram of an arrangement of pixels for performing a gray scale compensation process with gray scale compensation parameters for each level of gray scale compensation areas from a proximal image area to an intermediate image area of the chip according to an embodiment of the present disclosure.
Figure 22:
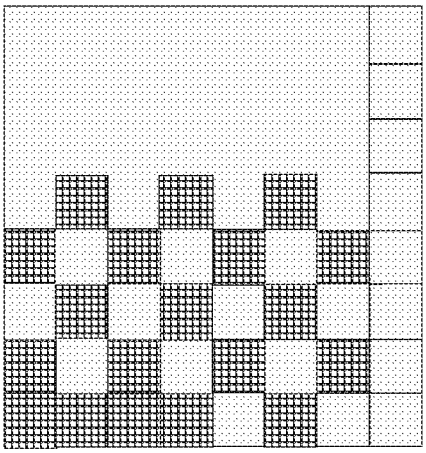
FIG. 22 shows a diagram of an arrangement of pixels for performing a gray scale compensation process according to target gray scale compensation parameters in each level of gray scale compensation areas from a left image area to a corresponding image area of the chip according to an embodiment of the present disclosure.

For example, FIG. 21 shows a diagram of an arrangement of pixels for performing a gray scale compensation process according to target gray scale compensation parameters in each level of gray scale compensation areas from the chip proximal image area to the chip intermediate image area according to an embodiment of the present disclosure; And FIG. 22 shows a diagram of an arrangement of pixels for performing a gray scale compensation process according to target gray scale compensation parameters in each level of gray scale compensation areas from a left image area to a corresponding image area of the chip according to an embodiment of the present disclosure. The target gray scale compensation parameter here can be understood as the gray scale compensation parameter of the pixels of the gray scale compensation area which is the farthest from the chip corresponding image area or the chip intermediate image area among the current-level gray scale compensation areas. For example, for the pixels in the $64^{th}$ row to the $57^{th}$ row, the target gray scale compensation parameter of the first-level gray scale compensation area formed by these pixels is equal to 1. For the pixels in the $56^{th}$ row to the $49^{th}$ row, the target gray scale compensation parameter of the second-level gray scale compensation area formed by these pixels is equal to 2, which will not be repeated.

Figure 23:
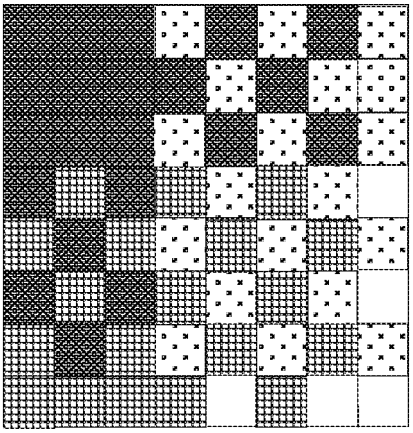
FIG. 23 shows a schematic diagram of pixel superposition formed in FIGS. 21 and 22.

The pixel arrangement shown in FIG. 23 can be obtained by superimposing the pixel arrangement shown in FIG. 21 with the pixel arrangement shown in FIG. 22. It can be seen from FIGS. 21 to 23 that: after the image pixels are gray-scale compensated along the first direction and the second direction, some pixels undergo a two-direction gray scale compensation, which is two-dimensional gray scale compensation, but some pixels are gray-scale compensated only in one direction, which is one-dimensional compensation.

Assuming that the image brightness information only comprises the brightness information of 3 of first sub-image areas arranged in the first direction, wherein the intermediate sub-image areas are disposed between two adjacent first sub-image areas. The schematic diagram of the arrangement of sub-image areas along the first direction is shown in FIG. 13. The definition of the 3 of first sub-image areas may be referred to the foregoing. Among the others, when the brightness of the band point comprised in the chip intermediate image area ICZ is the reference brightness, it is only necessary to perform gray scale compensation for the pixels comprised in the chip distal area and the pixels comprised in the chip proximal area. Table 1 shows a lookup table of the gray scale compensation parameters of the chip proximal image area ICJ and the chip distal image area ICY. Table 2 shows a table of LRU of the image information before and after the gray scale compensation with the gray scale compensation parameters shown in Table 1. The image information is the image information displayed on an 8-bit display panel of a certain model.

Table 1 shows a lookup table of the gray scale compensation parameters of the chip proximal image area ICJ and the chip distal image area ICY.

| | Gray scale compensation parameters of the chip proximal image area | Gray scale compensation parameters of the chip distal image area |
|---|---|---|
| 0-36 | 0 | 0 |
| 37-101 | −1 | 0 |
| 102-126 | −1 | 1 |
| 127-161 | −2 | 1 |
| 162-180 | −3 | 1 |
| 181-198 | −4 | 1 |
| 199 | −5 | 1 |
| 200-214 | −5 | 2 |
| 215-225 | −6 | 2 |
| 226 | −6 | 3 |
| 227-239 | −7 | 3 |
| 240-245 | −8 | 3 |
| 246-251 | −8 | 4 |
| 252 | −9 | 4 |
| 253 | −9 | 4 |
| 254 | −9 | 4 |
| 255 | −9 | 4 |

Table 2 shows a table of LRU of the image information before and after the gray scale compensation.

| Serial number | LRU before the compensation (%) | LRU after the compensation (%) | Meet the standard or not | Compliance rate |
|---|---|---|---|---|
| 1 | 85.3 | 90.8 | Yes | 100% |
| 2 | 88.7 | 94.1 | Yes | |
| 3 | 90.5 | 95.6 | Yes | |
| 4 | 87.7 | 93.0 | Yes | |
| 5 | 86.3 | 91.8 | Yes | |
| 6 | 85.4 | 90.7 | Yes | |
| Average LRU | 87.3 | 92.7 | — | — |

-continued

| Serial number | LRU before the compensation (%) | LRU after the compensation (%) | Meet the standard or not | Compliance rate |
|---|---|---|---|---|
| Standard deviation | 0.019 | 0.018 | — | — |
| Confidence interval (95%) | [0.858, 0.888] | [0.912, 0.941] | — | — |

It can be seen from Table 2 that when the compensation parameters shown in Table 1 are used for the image information, the LRU of the image after the compensation is greater than the LRU of the image before the compensation, and all of the LRU of the image after the compensation are greater than 90%. At the same time, it can be known from the analysis of the LRU of the image before and after the compensation with the standard deviation and the confidence interval before and after the compensation that, the image processing method according to the embodiments of the present disclosure is effective for gray scale compensation of the image.

Figure 24:
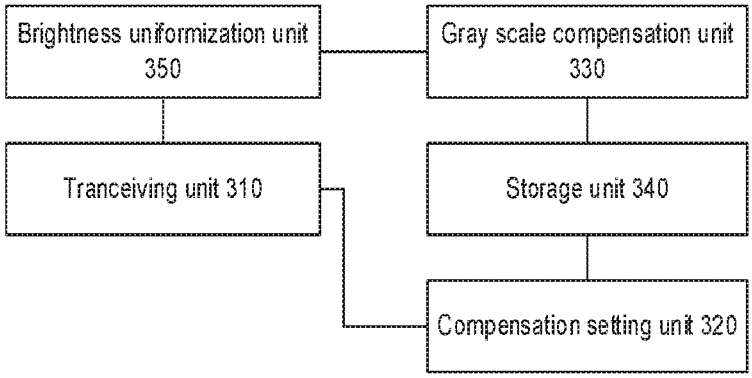
FIG. 24 shows a structural diagram of a pixel processing device according to an embodiment of the present disclosure.

The embodiments of the present disclosure provide an image processing device. As shown in FIG. 8 and FIG. 24, the image processing device may comprise a transceiving unit 310, configured to acquire an image brightness information and an image information, the image brightness information at least comprising a brightness information of M of first sub-image areas arranged in a first direction, the brightness information of each first sub-image area comprises a brightness of at least two band points.

The imaging processing device further comprises a compensation setting unit 320 communicated with the transceiving unit 310 and configured to obtain the gray scale compensation parameter for the at least two band points comprised in each first sub-image area, according to the brightness information of the at least two band points comprised in the brightness information of each first sub-image area and a reference information $L_0$, and obtain the gray scale compensation information of each first sub-image area according to the gray scale compensation parameter of the at least two band points comprised in each first sub-image area. The imaging processing device further comprises the gray scale compensation unit 330 communicated with the tranceiving unit 310 and the compensation setting unit 320, and configured to perform the gray scale compensation process on the image information according to the gray scale compensation information of the M of first sub-image areas.

In some embodiments, as shown in FIG. 8 and FIG. 24, the forgoing image brightness information comprises the brightness information of N of second sub-image areas arranged in the second direction. The forgoing compensation setting unit 320 is further configured to obtain the gray scale compensation parameter for two band points comprised in each second sub-image area, according to the brightness information of the at least two band points comprised in the brightness information of each second sub-image area and the reference information $L_0$, and obtain the gray scale compensation information of each second sub-image area according to the gray scale compensation parameter of the at least two band points comprised in each second sub-image area.

As shown in FIG. 8 and FIG. 24, the forgoing gray scale compensation unit 330 is further configured to perform the gray scale compensation process on the image information according to the gray scale compensation information of the M of first sub-image areas, after receiving the image information.

In order to avoid setting the gray scale compensation information of each first sub-image area and the gray scale compensation information of each second sub-image area every time before the image processing, the image processing device further comprises The imaging processing device further comprises a storage unit 340 communicated with the compensation setting unit 320 and the gray scale compensation unit 330, and configured to store the gray scale compensation information of each first sub-image areas and the gray scale compensation information of each second sub-image areas.

In some embodiments, as shown in FIG. 9 and FIG. 24, the forgoing compensation setting unit 320 is specifically configured to obtain a reference gray scale $G_0$ according to the reference brightness $L_0$ and a brightness-gray scale relationship; obtain an average brightness of the band points comprised in each first sub-image area, according to the brightness of each band point comprised in the brightness information of each first sub-image area $\overline{L_1}$; obtain, according to the reference gray scale $G_0$, the reference brightness $L_0$ and the average brightness $\overline{L_1}$ of the band points comprised in the plurality of first sub-image areas, the gray scale compensation parameter of each band point of each first sub-image area; the gray scale compensation parameters $$\Delta G_1 = \alpha G_0\left(1 - \text{Gamma}\sqrt{\frac{L_0}{\overline{L_1}}}\right)$$

of each band point comprised in each first sub-image area, $\alpha$ is greater than or equal to 0.5 but less than or equal to 1, and Gamma is a display parameter.

As shown in FIG. 11, the reference gray scale $G_0$ is obtained according to the reference brightness $L_0$ and a brightness-gray scale relationship. The average brightness of the band points comprised in each second sub-image area is obtained according to the brightness of each band point comprised in the brightness information of each second sub-image area $\overline{L_2}$. The gray scale compensation parameter $\overline{L_2}$ of each band point included in each second sub-image area is obtained according to the reference gray scale $G_0$, the reference brightness $L_0$ and the average brightness of each band point of each second sub-image area $\overline{L_2}$. For each second sub-image area, the gray scale compensation parameter $\Delta G_2$, $$\Delta G_2 = \beta G_0\left(1 - \text{Gamma}\sqrt{\frac{L_0}{\overline{L_2}}}\right)$$

of each band point included in each second sub-image area is obtained, wherein $\beta$ is greater than or equal to 0.5 but less than or equal to 1.

For example, when $M \geq 2$ and $N=0$, $\alpha=1$. When $M=0$ and $N \geq 2$, $\beta=1$. When $M \geq 2$ and $N \geq 2$, $\alpha$ and $\beta$ are both greater than or equal to 0.5 and less than or equal to 1.

In some embodiments, as shown in FIG. 17 and FIG. 24, the image brightness information comprises the brightness information of the plurality of primary color images and white image brightness information. The above gray scale compensation unit 330 is further configured to perform the gray scale compensation on the respective primary pixels of the M of first sub-image area comprised in the image information by using the gray scale compensation information of the M of first sub-image areas corresponding to the white image, when the image information is the gray scale information. The gray scale compensation is performed on the respective primary pixels of the N of second sub-image areas included in the image information by using the gray scale compensation information of the N of second sub-image areas corresponding to the white image.

As shown in FIG. 9 and FIG. 24, when the forgoing image information is the color image information, the gray scale compensation is performed on the respective primary pixels of the M of first sub-image area comprised in the image information by using the gray scale compensation information of the N of first sub-image areas corresponding to the white image; and/or, the gray scale compensation is performed on the corresponding primary pixels of the N of second sub-image areas included in the image information by using the gray scale compensation information of the N of second sub-image areas corresponding to the plurality of primary color images.

In some embodiments, as shown in FIG. 8 and FIG. 24, the forgoing gray scale compensation unit 330 is further configured to: after receiving the image information, The gray scale compensation process is performed on the image information according to the gray scale compensation information of the M of first sub-image areas, or the gray scale compensation process is performed on the image information according to the gray scale compensation information of the N of second sub-image areas, when the average gray scale of at least one primary color included the image information being greater than the gray scale threshold of the corresponding primary color.

In some embodiments, the forgoing reference brightness $L_0$ is the average brightness of the band points of the target first sub-image area, the first direction being the same as the direction away from the signal chip, the target first sub-image area is the $k^{th}$ first sub-image area along the direction away from the signal chip, and k is an integer greater than or equal to 2 but less than or equal to M.

As shown in FIG. 19 and FIG. 24, the forgoing gray scale compensation unit 330 is specifically configured to obtain the gray scale infiltration compensation information of the image along the first direction according to the gray scale compensation information of the M of first sub-image areas, so that the gray scale infiltration compensation information along the first direction of the image information increase or decrease in the direction close to the $k^{th}$ first sub-image area, perform the infiltration gray scale compensation on the image information according to the gray scale infiltration compensation information of the image information along the first direction.

As shown in FIG. 20, the gray scale infiltration compensation information of the image information along the second direction is obtained according to the gray scale compensation information of the N of second sub-image areas, so that the gray scale infiltration compensation information of the image information along the second direction gradually increases or decreases in the direction from $1^{st}$ second sub-image area to the $t^{th}$ second sub-image area. The $k^{th}$ first sub-image area has a geometric center positioned in the $t^{th}$ second sub-image area. The infiltration gray scale compensation on the image information according to the gray scale infiltration compensation information of the image information along the second direction.

In some embodiment, as shown in FIG. 8 and FIG. 24, the forgoing image processing device further comprises a brightness uniformization unit 350 configured to perform a brightness uniformization process on the image information by a brightness uniformization method, after receiving the image information and before performing the gray scale compensation process on the image information according to the gray scale compensation information of the M of first sub-image areas.

The embodiments of the present disclosure also provides a display device. The display device comprises the above-described image processing device.

The display device may be any product or component having a display function, such as, a mobile phone, a tablet computer, a TV, a display, a notebook computer, a digital photo frame, a navigator, or the like.

The embodiments of the present disclosure also provides a computer storage medium. The computer storage medium stores instructions, and when the instructions are executed, the above image processing method is implemented.

The above instructions may be stored in a computer-readable storage medium or transmitted from one computer-readable storage medium to another computer-readable storage medium. For example, the instructions may be transmitted from a website, a computer, a server, or a data center via a cable (such as the same Axis cable, optical fiber, digital subscriber line (DSL)) or wirelessly (such as infrared, wireless, microwave, etc.) to another website, computer, server or data center. The computer storage medium may be any available medium that the computer can store or a data storage device such as a server, a data center, and the like that comprises one or more available integrated medium. The available media may be magnetic media (for example, floppy disk, hard disk, magnetic tape), optical media (for example, DVD), or semiconductor media (for example, Solid State Disk, SSD).

Figure 25:
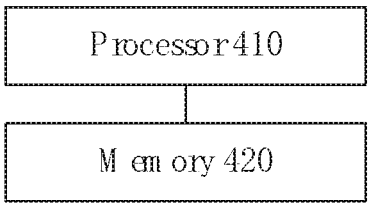
FIG. 25 shows a structural diagram of a pixel processing device according to an embodiment of the present disclosure.

As shown in FIG. 25, the embodiments of the present disclosure provide an image processing device, comprising a memory 420 and a processor 410, wherein the memory 420 have instructions stored thereon. Certainly, the memory 420 may also have the gray scale compensation information of each first sub-image area and the gray scale compensation information of each second sub-image area stored thereon. The above processor 410 is configured to execute the instruction to realize the above image processing method.

Figure 26:
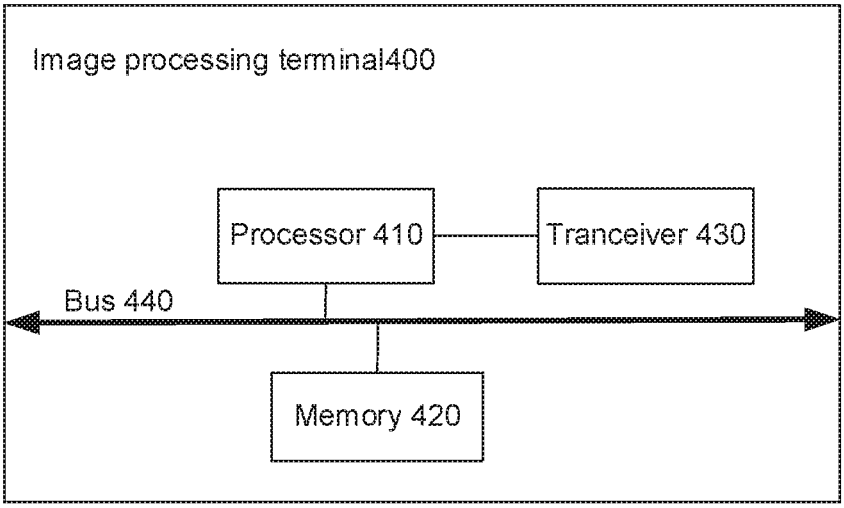
FIG. 26 shows a structural diagram of a pixel processing terminal according to an embodiment of the present disclosure.

As shown in FIG. 26, the present disclosure further provides an image processing terminal 400. The image processing terminal comprises a processor 410, a memory 420, a transceiver 430, and a bus 440; wherein the processor 410, the memory 420, and the transceiver 430 communicate with each other through the bus 440. The memory 420 is configured to store the computer instructions, and the above processor 410 is configured to execute the computer instruction to implement the above image processing method.

The processor 410 described in the embodiment of the present disclosure may be a processor, or a collective term for multiple processing elements. For example, the processor 410 may be a central processor (CPU), an application specific integrated circuit (ASIC), or one or more integrated circuits configured to implement the embodiments of the present disclosure, such as, one or more micro-processor (digital signal processor, DSP), or one or more field programmable gate array (FPGA).

The memory 420 may be a storage device, or a collective term for multiple storage elements, and is used to store executable program code and the like. The memory 420 may comprise random access memory (RAM), and may also comprise non-volatile memory, such as magnetic disk memory, flash memory (Flash), and so on.

The bus 440 may be an industry standard architecture (ISA) bus, a peripheral component interconnection (PCI) bus, an extended industry standard architecture (EISA) bus, or the like. The bus can be divided into an address bus, a data bus, a control bus and so on. For ease of representation, the bus is only represented by a thick line in FIG. 26, but it does not mean that there is only one bus or one type of buses.

Figure 27:
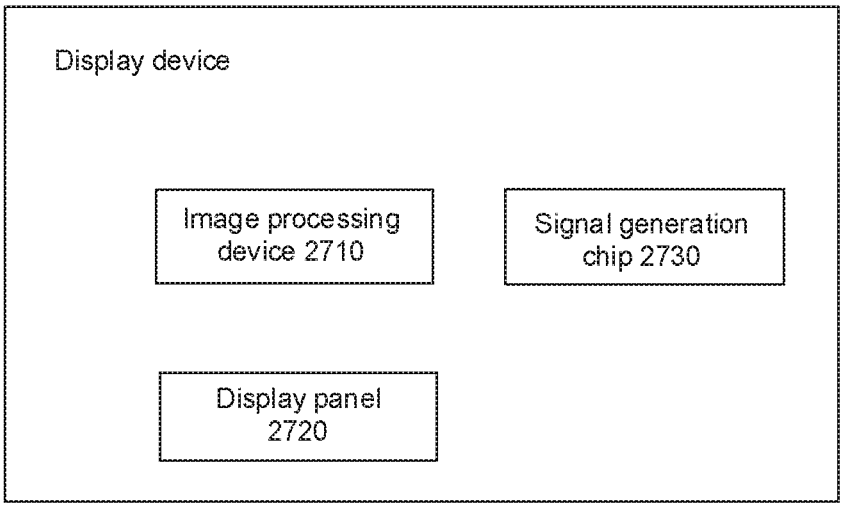
FIG. 27 is a block diagram of the display apparatus according to an embodiment of the present disclosure.

FIG. 27 shows a display device. The display device may comprise the image processing device 2710 according to an embodiment of the present disclosure, a display panel 2720, and a signal generation chip 2730.

The embodiments in this specification are described in a progressive manner. The same or similar parts between the embodiments can be referred to each other. Each embodiment focuses on the differences from other embodiments. In particular, since the device embodiment is basically similar to the method embodiment, the description of the device embodiment is relatively simple, and the relevant part can be referred to the description of the method embodiment.

The above description is only specific implementations of the present disclosure, but the scope of the present disclosure is not limited to this. Those skilled in the art can easily conceive changes or replacements within the technical scope disclosed in the present disclosure, which should be covered by the scope of the present disclosure. Therefore, the scope of the present disclosure should be defined by the scope of the claims.

We claim:

1. An image processing method, comprising:

acquiring an image brightness information of an image to be displayed, the image brightness information comprising a brightness information of M of first sub-image areas arranged in a first direction, the brightness information of each first sub-image area among the M of first sub-image areas comprises a brightness information of at least two band points, M is an integer greater than 1;

obtaining a gray scale compensation parameter of the at least two band points for each first sub-image area, according to the brightness information of the at least two band points for each first sub-image area and a reference brightness $L_0$;

obtaining a gray scale compensation information of each first sub-image area, according to the gray scale compensation parameter of the at least two band points for each first sub-image area; and performing a gray scale compensation process on an image information of the image, according to the gray scale compensation information of the M of first sub-image areas, wherein the obtaining the gray scale compensation parameter of the at least two band points for each first sub-image area according to the brightness information of the at least two band points for each first sub-image area and the reference brightness $L_0$ comprises:

obtaining a reference gray scale $G_0$ associated with the reference brightness $L_0$ based on a preset brightness-gray scale relationship;

obtaining an average brightness $\overline{L}_1$ of the at least two band points for each first sub-image area, according to the brightness of each band point from the brightness information of each first sub-image area; and obtaining the gray scale compensation parameter $\Delta G_1$ of each band point for each first sub-image area according to the reference gray scale $G_0$, the reference brightness $L_0$ and the average brightness of the band points $\overline{L}_1$, wherein $$\Delta G_1 = \alpha * G_0\left(1 - \text{Gamma}*\sqrt{\frac{L_0}{\overline{L}_1}}\right),$$

$\alpha$ is greater than or equal to 0.5 but less than or equal to 1, and Gamma is a display parameter.

2. The image processing method of claim 1, wherein the image brightness information further comprises a brightness information of N of second sub-image areas arranged in a second direction which is perpendicular to the first direction, the brightness information of each second sub-image comprises a brightness information of at least two band points, N is an integer greater than 1;

the image processing method further comprises:

obtaining a gray scale compensation parameter of the at least two band points for each second sub-image area, according to the brightness information of the at least two band points for each second sub-image area and the reference brightness $L_0$;

obtaining a gray scale compensation information of each second sub-image area, according to the gray scale compensation parameter of the at least two band points for each second sub-image area; and performing a gray scale compensation process on an image information of the image, according to the gray scale compensation information of the N of second sub-image areas.

3. The image processing method of claim 2, wherein the obtaining the gray scale compensation parameter of the at least two band points for each second sub-image area according to the brightness information of the at least two band points for each second sub-image area and a reference brightness $L_0$ comprises:

obtaining an average brightness $\overline{L}_2$ of the band points for each second sub-image area, according to the brightness of each band point from the brightness information of each second sub-image area $\overline{L}_2$;

obtaining the gray scale compensation parameter $\Delta G_2$ of each band point for each second sub-image area according to the reference gray scale $G_0$, the reference brightness $L_0$ and the average brightness $\overline{L}_2$ of the band points; wherein $$\Delta G_2 = \beta * G_0\left(1 - \text{Gamma}*\sqrt{\frac{L_0}{\overline{L}_2}}\right),$$

$\beta$ is greater than or equal to 0.5 but less than or equal to 1.

4. The image processing method of claim 3, wherein the image processing method is applied to a display device comprising a display panel and a signal processor, wherein the display panel comprises the plurality of first sub-images areas, the reference brightness $L_0$ is the average brightness of the band points for a target first sub-image area, the first direction is a direction away from a signal generation chip, the target first sub-image area is the $k^{th}$ first sub-image area along the first direction, and k is an integer greater than or equal to 2 but less than or equal to M;

wherein performing the gray scale compensation process on the image information according to the gray scale compensation information of the M of first sub-image areas comprises:

obtaining a gray scale infiltration compensation information of the image along the first direction according to the gray scale compensation information of the M of first sub-image areas, so that the gray scale infiltration compensation information along the first direction increases or decreases in a direction close to the $k^{th}$ first sub-image area; and performing an infiltration gray scale compensation on the image information according to the gray scale infiltration compensation information along the first direction;

wherein performing the gray scale compensation process on the image information according to the gray scale compensation information of the N of second sub-image areas comprises:

obtaining the gray scale infiltration compensation information of the image along the second direction according to the gray scale compensation information of the N of second sub-image areas, so that the gray scale infiltration compensation information along the second direction increases or decreases in a direction from $1^{st}$ second sub-image area to the $t^{th}$ second sub-image area, the $k^{th}$ first sub-image area has a geometric center positioned in the $t^{th}$ second sub-image area; and performing the infiltration gray scale compensation on the image information according to the gray scale infiltration compensation information along the second direction.

5. The image processing method of claim 2, wherein the image brightness information comprises a plurality of primary color image brightness information and white image brightness information;

the method also comprises:

determining whether the image is a gray scale image or a color image;

compensating the gray scale of each primary color pixel of the image along the second direction by using the gray scale compensation information of the N of second sub-image areas corresponding to the white image brightness information, in response to determining that the image is the gray scale image; and compensating the gray scale of each primary color pixel of the image along the second direction by using the gray scale compensation information of the N of second sub-image areas corresponding to the plurality of primary color image brightness information, in response to determining that the image is the color image.

6. The image processing method of claim 1, wherein the image brightness information comprises a plurality of primary color image brightness information and white image brightness information;

the method also comprises:

determining whether the image is a gray scale image or a color image;

compensating the gray scale of each primary color pixel of the image along the first direction by using the gray scale compensation information of the M of first sub-image areas corresponding to the white image brightness information, in response to determining that the image is the gray scale image; and compensating the gray scale of each primary color pixel of the image along the first direction by using the gray scale compensation information of the M of first sub-image areas corresponding to the plurality of primary color image brightness information, in response to determining that the image is the color image.

7. The image processing method of claim 6, further comprising:

compensating the gray scale of each primary color pixel of the image along the second direction by using the gray scale compensation information of the N of second sub-image areas corresponding to the white image brightness information, in response to determining that the image is the gray scale image; and compensating the gray scale of each primary color pixel of the image along the second direction by using the gray scale compensation information of the N of second sub-image areas corresponding to the plurality of primary color image brightness information, in response to determining that the image is the color image.

8. The image processing method of claim 1, wherein performing the gray scale compensation process on the image information according to the gray scale compensation information of the M of first sub-image areas, or performing the gray scale compensation process on the image information according to the gray scale compensation information of the N of second sub-image areas, in response to an average gray scale of at least one primary color of the image being greater than a gray scale threshold of the at least one primary color.

9. The image processing method of claim 1, further comprising:

performing a brightness uniformization process on the image information by using a brightness uniformization method.

10. An image processing device, comprising:

a memory having instructions stored thereon; and a processor configured to execute the instructions so as to implement the image processing method of claim 1.

11. A display device, comprising the image processing device of claim 10.

12. A display device, comprising:

a display panel;

a signal generation chip; and the image processing device of claim 10.

* * * * *